US009801783B2

(12) United States Patent
Perović

(10) Patent No.: US 9,801,783 B2
(45) Date of Patent: Oct. 31, 2017

(54) COLLAPSIBLE SAUNA

(71) Applicant: PARMIS d.o.o., Ljubljana—Črnuče (SI)

(72) Inventor: Milan Perović, Ljubljana (SI)

(73) Assignee: PARMIS D.O.O., Ljubljana-Crnuce (SI)

( * ) Notice: Subject to any disclaimer, the term of this patent is extended or adjusted under 35 U.S.C. 154(b) by 10 days.

(21) Appl. No.: 14/605,210

(22) Filed: Jan. 26, 2015

(65) Prior Publication Data

US 2016/0051441 A1 Feb. 25, 2016

Related U.S. Application Data

(63) Continuation-in-part of application No. 29/507,085, filed on Oct. 23, 2014, now Pat. No. Des. 779,079.

(30) Foreign Application Priority Data

Aug. 19, 2014 (EM) ..... 002521898-0001
Aug. 19, 2014 (EM) ..... 002521898-0002

(51) Int. Cl.
*A61H 33/06* (2006.01)
*E04H 1/12* (2006.01)
*E04B 1/343* (2006.01)

(52) U.S. Cl.
CPC ... *A61H 33/066* (2013.01); *A61H 2201/0161* (2013.01); *E04B 1/3431* (2013.01); *E04H 2001/1288* (2013.01)

(58) Field of Classification Search
CPC ..... E04H 2001/1288; E04B 1/34373; A61H 2201/0161; A61H 33/066; A61H 33/067
(Continued)

(56) References Cited

U.S. PATENT DOCUMENTS 148,487 A * 3/1874 Shaffer ..... A61H 33/06 4/527
348,923 A * 9/1886 Munro ..... A61H 33/06 4/524

(Continued)

FOREIGN PATENT DOCUMENTS

EM 000111802-0002 3/2004
JP S59-20166 A 2/1984

(Continued)

OTHER PUBLICATIONS

"New arrival half body folder and portable sauna infrared sauna cabin", Retrieved from URL http://www.alibaba.com/product-detail/New-arrival-half-body-folder-and_60070011165.html [Jun. 22, 2015].

(Continued)

*Primary Examiner* — Erin Deery
(74) *Attorney, Agent, or Firm* — Bryant J. Keller; Kirton McConkie

(57) ABSTRACT

While such systems and methods can include any suitable component, in some cases, they include a first and a second piece of sauna housing and a sauna heater. In some such cases, the second piece of sauna housing slidingly couples with the first piece to define an interior sauna chamber. Additionally, in some cases, a first portion of the second piece of sauna housing is configured to slidably fit within the first piece such that a volume of the sauna chamber is configured to increase and decrease, respectively, when the second piece is moved into an extended position or when the second piece is moved from the extended position into a collapsed position in which the second piece nests within the first piece. In some cases, the first and second pieces include a ceiling that is configured to extend over a user within the sauna chamber. Other implementations are described.

1 Claim, 39 Drawing Sheets

(58) Field of Classification Search
USPC ..... 4/524–534
See application file for complete search history.

(56) References Cited

U.S. PATENT DOCUMENTS

| | | | | | |
|---|---|---|---|---|---|
| 548,641 | A * | 10/1895 | Hollem | A61H 33/06 | 4/527 |
| 1,917,629 | A * | 7/1933 | Anderson | A61H 33/06 | 312/258 |
| 3,648,299 | A | 3/1972 | Durst | | |
| 3,875,596 | A * | 4/1975 | Noda | A61H 33/06 | 4/527 |
| 4,031,573 | A * | 6/1977 | Romanoff | A61H 33/06 | 392/368 |
| 5,117,481 | A | 5/1992 | Sung | | |
| 5,894,698 | A * | 4/1999 | Dewald, Jr. | E04B 1/3431 | 296/171 |
| 6,471,275 | B1 * | 10/2002 | Kunz | B60P 3/34 | 296/171 |
| D663,853 | S | 7/2012 | Zack et al. | | |
| 2002/0046422 | A1 | 4/2002 | Perett | | |
| 2005/0076430 | A1 | 4/2005 | Lee | | |
| 2007/0050903 | A1 | 3/2007 | Sappenfield et al. | | |
| 2007/0169258 | A1 * | 7/2007 | Hoge | A61H 33/06 | 4/527 |
| 2007/0294819 | A1 | 12/2007 | Levesque | | |
| 2008/0005980 | A1 | 1/2008 | Lin | | |
| 2010/0017953 | A1 | 1/2010 | O'Keefe et al. | | |
| 2012/0227178 | A1 | 9/2012 | Lee | | |
| 2014/0345041 | A1 * | 11/2014 | Barghelame | A61H 33/066 | 4/526 |
| 2016/0101017 | A1 * | 4/2016 | Lee | A61H 33/066 | 4/524 |

FOREIGN PATENT DOCUMENTS

| | | | | |
|---|---|---|---|---|
| JP | S61-171927 U | 10/1986 | | |
| JP | H01-120838 U | 8/1989 | | |
| JP | H02-139636 U | 11/1990 | | |
| KR | WO 2007069873 A1 * | 6/2007 | | A61H 33/06 |

OTHER PUBLICATIONS www.sinosauna.com; Retrieved from URL http://www.sinosauna.com/products.aspx [Jun. 22, 2015].

Folding Personal Sauna, posted at Mobilevenue.com, posting date Nov. 13, 2007, © Mobilevenue.com, [online], [site visited Nov. 19, 2015]. Available from Internet, <URL: http://www.mobilevenue.com/folding-personal-sauna-11133715/>.

* cited by examiner

COLLAPSIBLE SAUNA

CROSS-REFERENCE TO RELATED APPLICATION

This is a continuation-in-part of and claims priority to U.S. Design patent application Ser. No. 29/507,085, filed Oct. 23, 1014, and entitled "FOLDABLE SAUNA," which claims priority to registered community designs, Nos. 002521898-0001 and 002521898-0002, filed in the Office for Harmonization in the Internal Market Registration on Aug. 19, 2014, and relating to "COLLAPSIBLE SAUNAS;" the entire disclosures of which are both hereby incorporated by reference.

BACKGROUND OF THE INVENTION

1. Field of the Invention

The present invention relates to saunas. More particularly, the described invention relates to systems and methods for providing and using a collapsible sauna. While the sauna can have any suitable characteristics, in some cases, it includes a housing that has at least two pieces, namely a base member and an extension member, which together form an interior sauna chamber. In some cases, the extension member is configured to be extended from the base member to increase an internal volume of the sauna. Additionally, in some cases, the extension member is configured to slide from an extended configuration into the base member, or into a collapsed configuration, to reduce the size of the sauna's footprint.

2. Background and Related Art

While there are many different types of saunas, most saunas typically include a room or structure that is configured to provide wet or dry heat to one or more individuals to cause such individuals to perspire. Although saunas can also be heated in several manners, often times, saunas that heat air inside the saunas are classified as being "traditional", while saunas that warm objects (e.g., rocks, charcoal, active carbon fibers, etc.) are classified as being "infrared".

Saunas are used throughout the world for a wide variety of purposes. For instance, some sauna users use saunas to: open pores in the users' skin; provide a way for the users to relax; loosen up the users' muscles; increase the users' performance for an endurance sport; increase the users' heat tolerance threshold; reduce or relieve rheumatic pain and/or the symptoms associated with fibromyalgia, obstructive lung disease, glaucoma, rheumatoid arthritis, and a variety of other pains and ailments; provide the users with a way to clean themselves; to provide users with a way to detox; function as part of the users' religious observance; help the users' lose water weight; provide the users with a location and setting for social interaction; as well as for an assortment of other purposes.

Although saunas may provide a variety of benefits, conventional saunas are not necessarily without their shortcomings. In one example of a shortcoming, some saunas are relatively expensive to build. In another example, some saunas have a relatively large footprint or otherwise occupy a relatively large amount of space. In still another example, once some saunas are set up, their position becomes permanent. This permanency can be detrimental in several ways. For instance, when a person has such a sauna in their home and that person moves, he or she will likely have to leave the sauna behind.

Thus, while saunas currently exist that are used to provide wet and/or dry heat to their users, challenges still exist, including those listed above. Accordingly, it would be an improvement in the art to augment or even replace current techniques with other techniques.

SUMMARY OF THE INVENTION

The present invention relates to saunas. More particularly, the described invention relates to systems and methods for providing and using a collapsible sauna. While the sauna can have any suitable characteristics, in some cases, it includes a housing that has at least two pieces, namely a base member and an extension member, which together form an interior sauna chamber. In some cases, the extension member is configured to be extended from the base member to increase an internal volume of the sauna. Additionally, in some cases, the extension member is configured to slide from an extended configuration into the base member, or into a collapsed configuration, to reduce the size of the sauna's footprint.

While such systems and methods can include any suitable component, in some cases, they include a first and a second piece (or member) of sauna housing, and a sauna heater. In some such cases, the second member of sauna housing slidingly couples with the first piece to define an interior sauna chamber. Additionally, in some cases, a first portion of the second piece of sauna housing is configured to slidably fit within the first piece such that a volume of the sauna chamber is configured to increase and decrease, respectively, when the second piece is moved into an extended position or when the second piece is moved from the extended position into a collapsed position in which the second piece nests within the first piece. In some cases, the first and second pieces include a ceiling that is configured to extend over a user within the sauna chamber.

While the methods and processes of the present invention may be particularly useful for saunas that produce a relatively dry heat, those skilled in the art will appreciate that the described systems and methods can be used in a variety of different applications and in a variety of different areas of manufacture. For instance, the described systems and methods can be used to provide a collapsible steam room, or a sauna that produces wet heat.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above-recited and other features and advantages of the present invention are obtained, a more particular description of the invention will be rendered by reference to specific embodiments thereof, which are illustrated in the appended drawings. Understanding that the drawings are not necessarily drawn to scale or in proper proportion, and that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to saunas. More particularly, the described invention relates to systems and methods for providing and using a collapsible sauna. While the sauna can have any suitable characteristics, in some cases, it includes a housing that has at least two pieces, namely a base member and an extension member, which together form an interior sauna chamber. In some cases, the extension member is configured to be extended from the base member to increase an internal volume of the sauna. Additionally, in some cases, the extension member is configured to slide from an extended configuration into the base member, or into a collapsed configuration, to reduce the size of the sauna's footprint.

In the disclosure and in the claims, the term sauna (and variations thereof) may be used to refer to a building, room, container, and/or other suitable structure that is configured to be at least partially heat insulative, and that is configured to provide wet and/or dry heat to a person disposed therein. In this regard, some examples of such saunas include, but are not limited to, traditional saunas, infrared saunas, steam rooms, steam saunas, smoke saunas, and Finnish saunas.

As used herein, the term collapsed configuration, collapsed position, and variations thereof, may refer to configurations which pieces of the described sauna's housing are moved to a position that provides the sauna within its smallest footprint.

As used herein, the terms extended configuration, extended position, and variations thereof, may refer to a configuration in which one or more pieces of the sauna's housing are extended from each other to provide the sauna with a larger footprint than the sauna has when it is in the collapsed position.

Figure 1A:
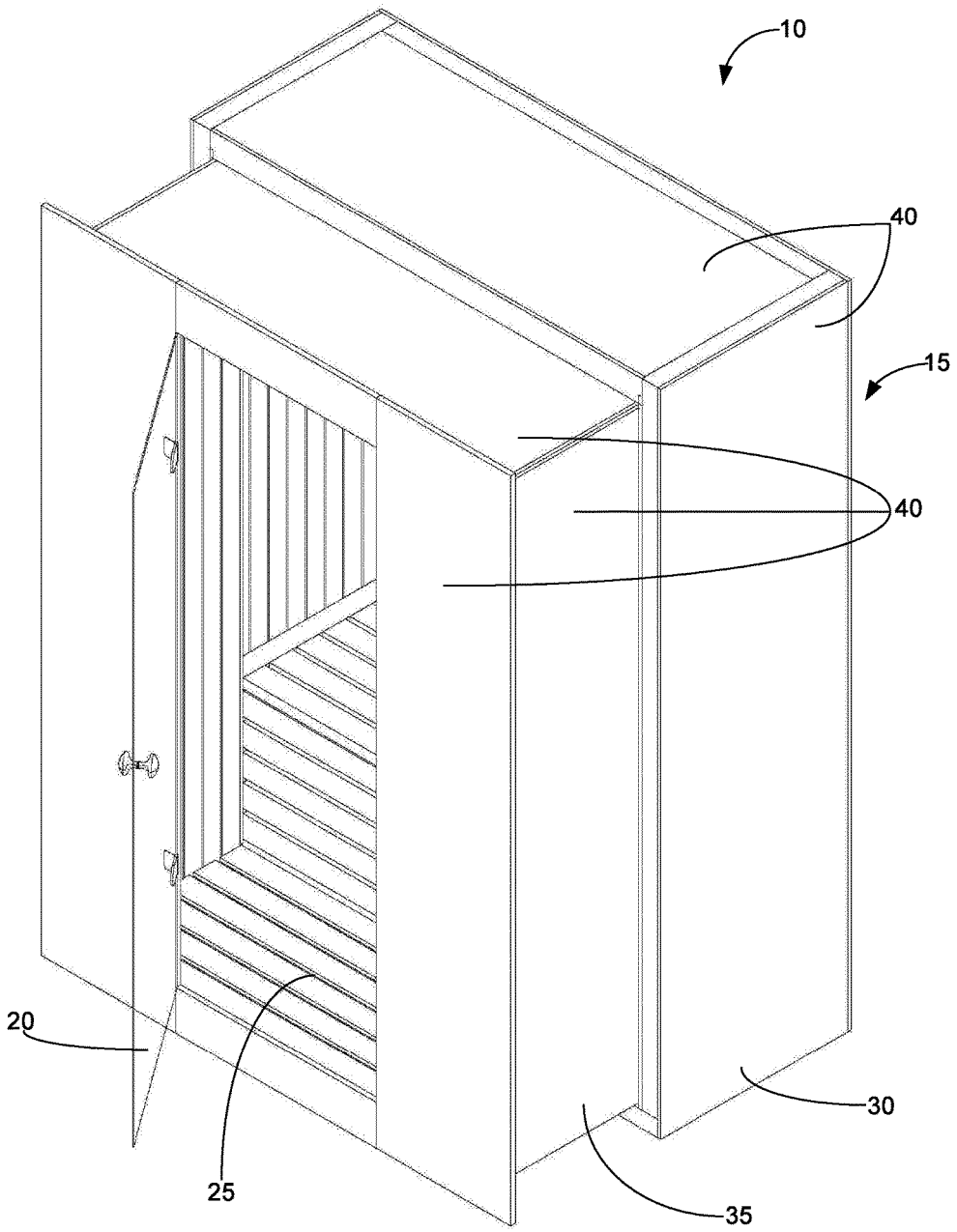
FIG. 1A illustrates a perspective view of a collapsible sauna in an extended configuration, in accordance with a representative embodiment of the invention.
Figure 1B:
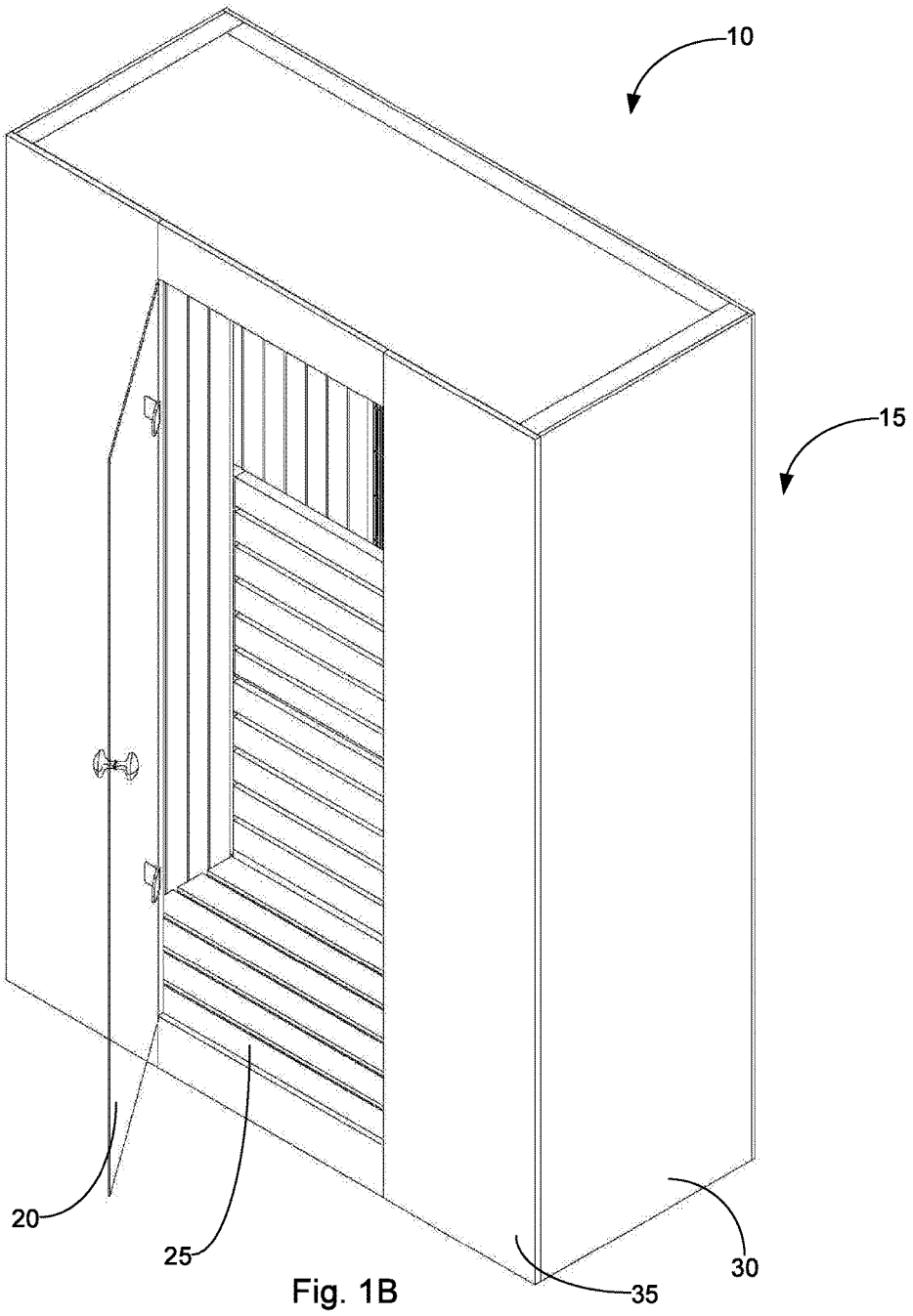
FIG. 1B illustrates a perspective view of the collapsible sauna in a collapsed configuration, in accordance with a representative embodiment of the invention.
Figure 2A:
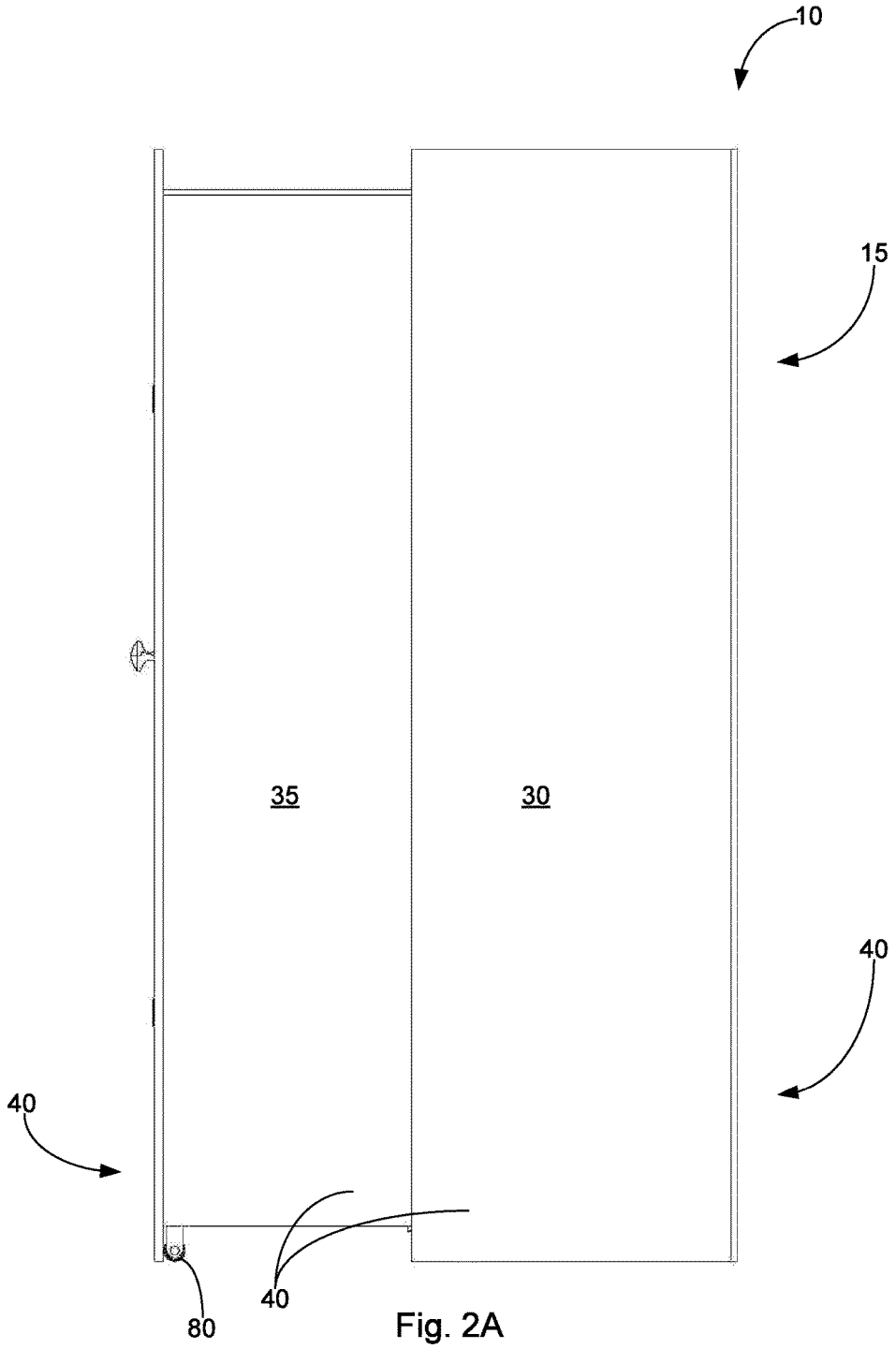
FIG. 2A illustrates a side view of a representative embodiment of the sauna in the extended configuration.
Figure 2B:
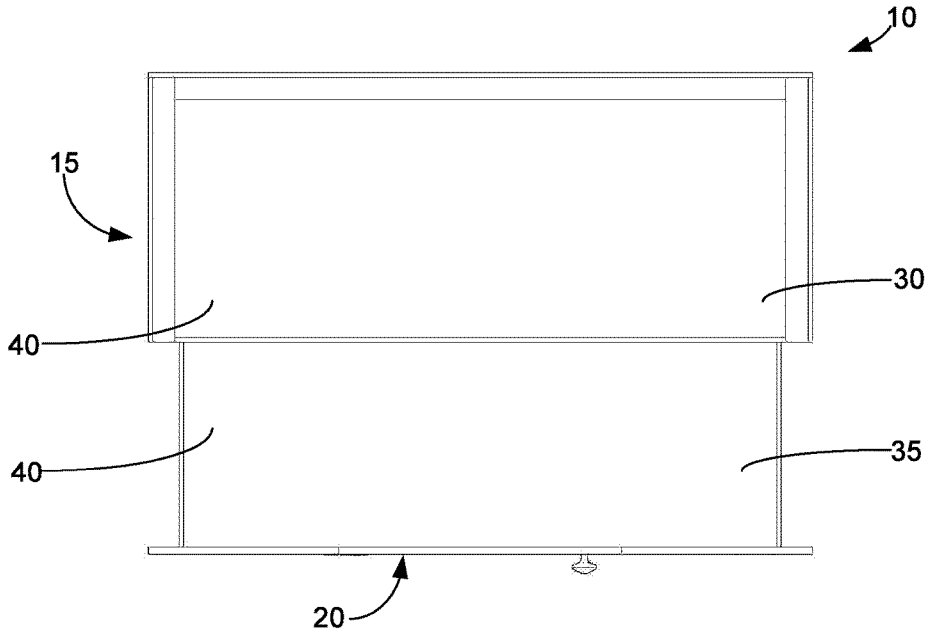
FIGS. 2B-2C respectively illustrate a top and a bottom view of a representative embodiment of the sauna.
Figure 2C:
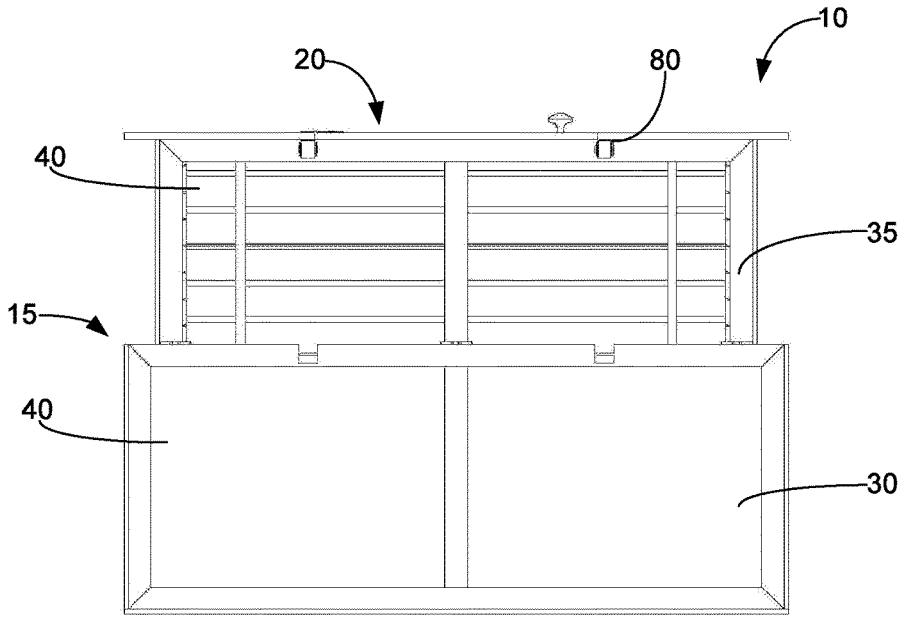
Figure 2D:
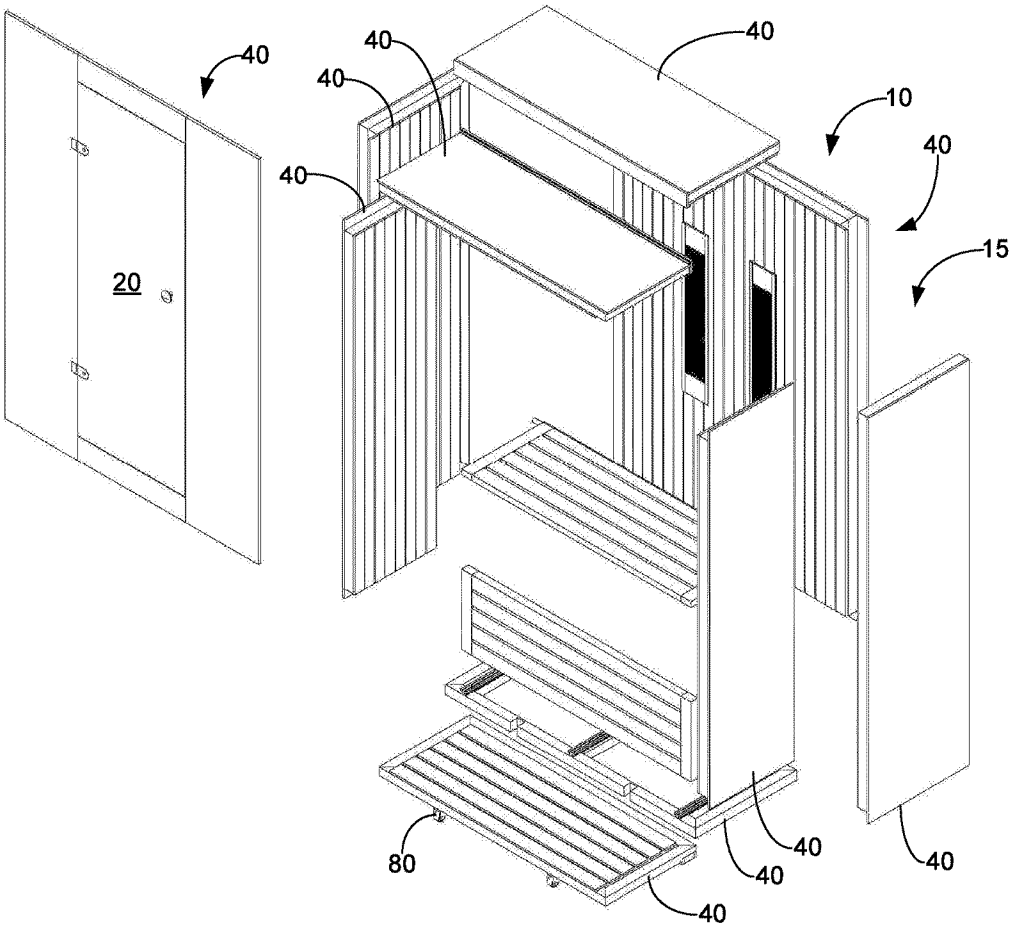
FIG. 2D illustrates an exploded view of a representative embodiment of the sauna.
Figure 2E:
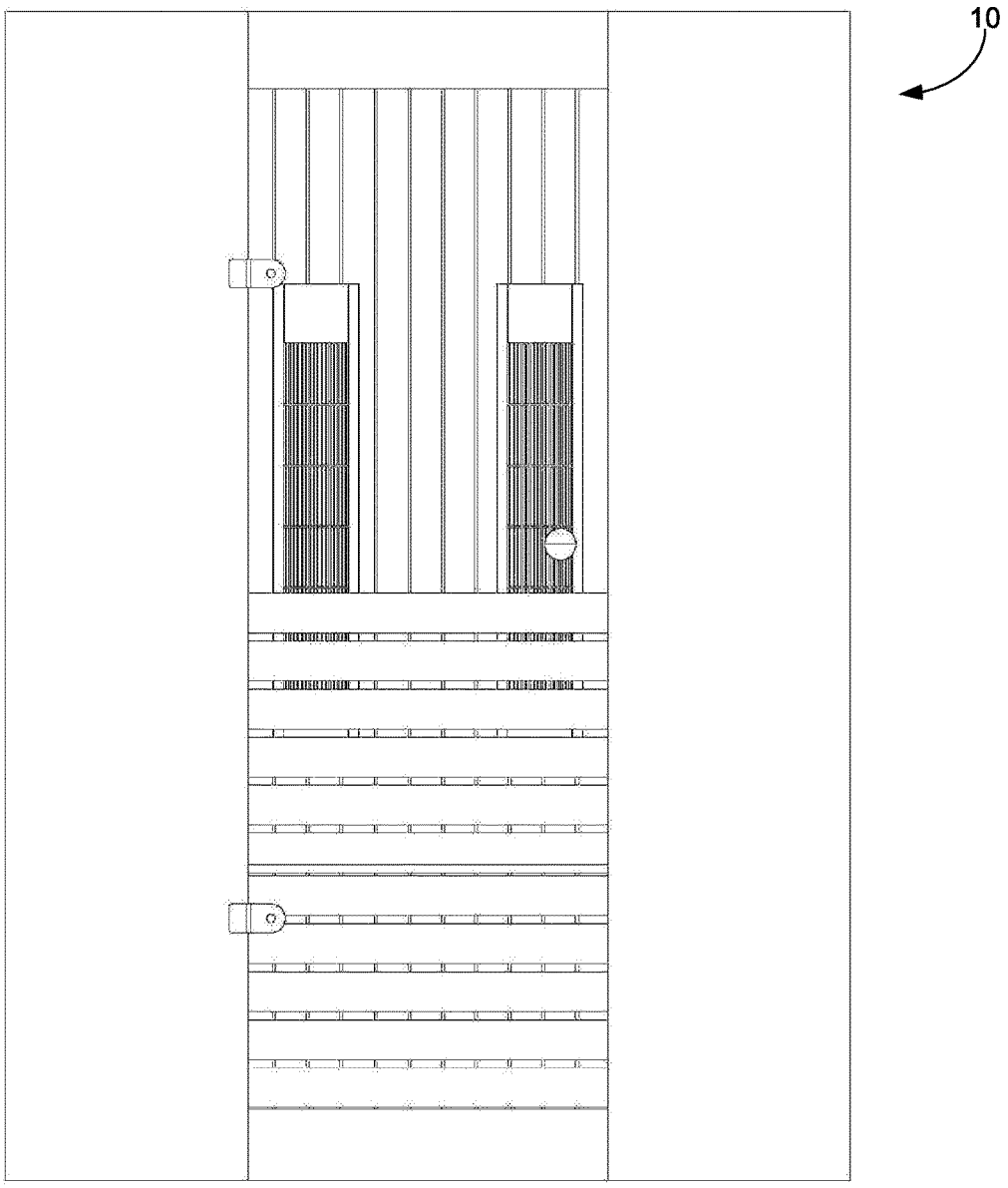
FIGS. 2E-2H respectively illustrate a front view, a side view, a top view, and a bottom view of a representative embodiment of the sauna.
Figure 2F:
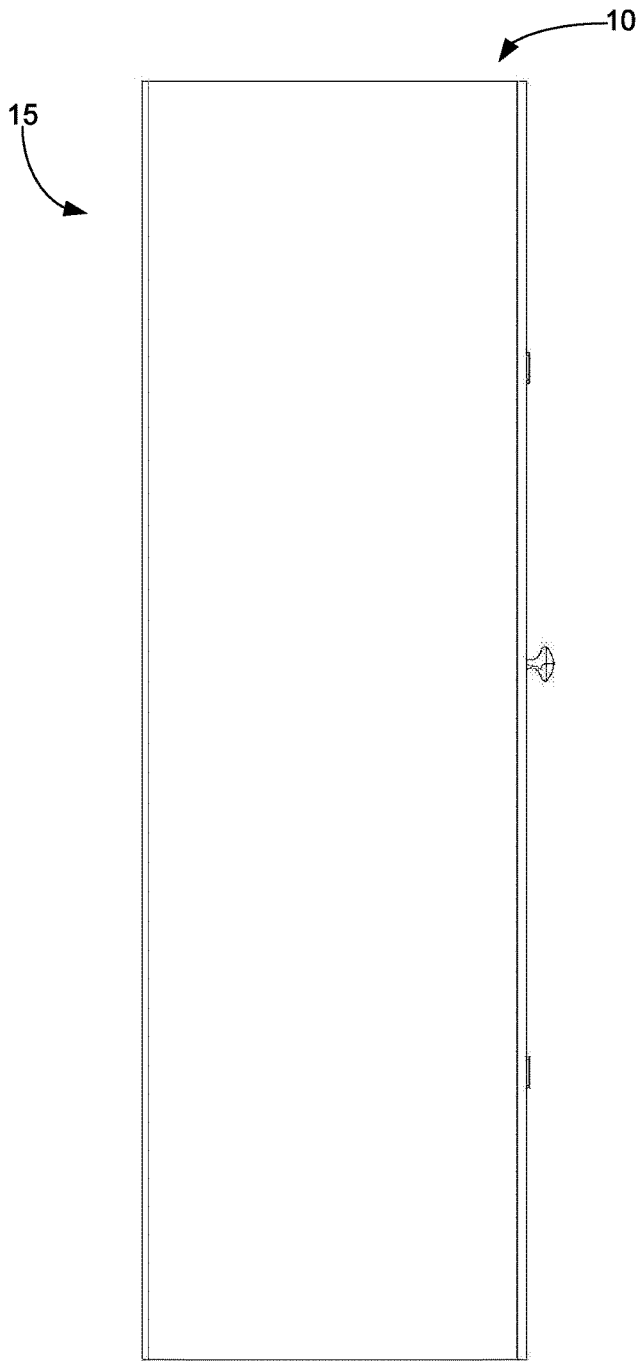
Figure 2G:
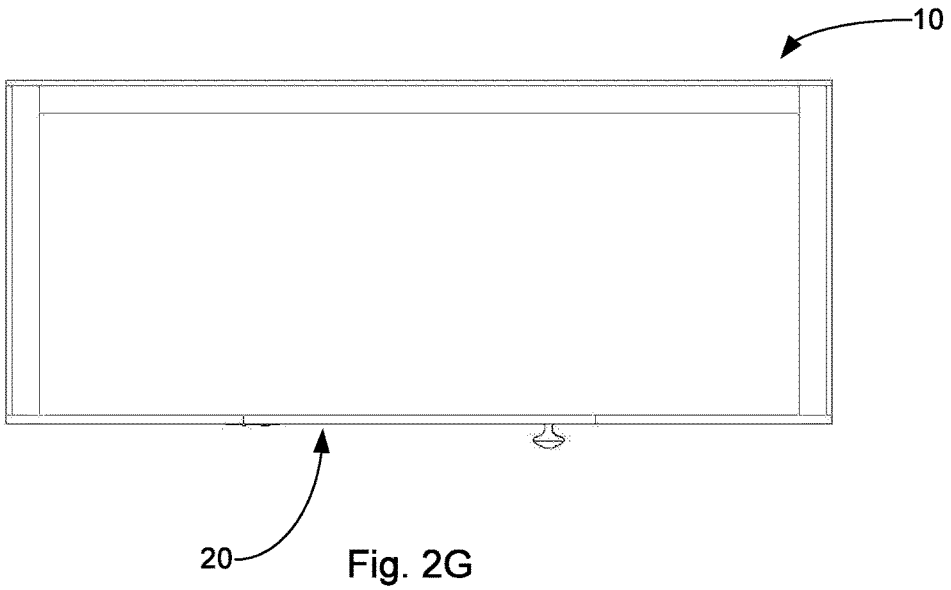
Figure 2H:
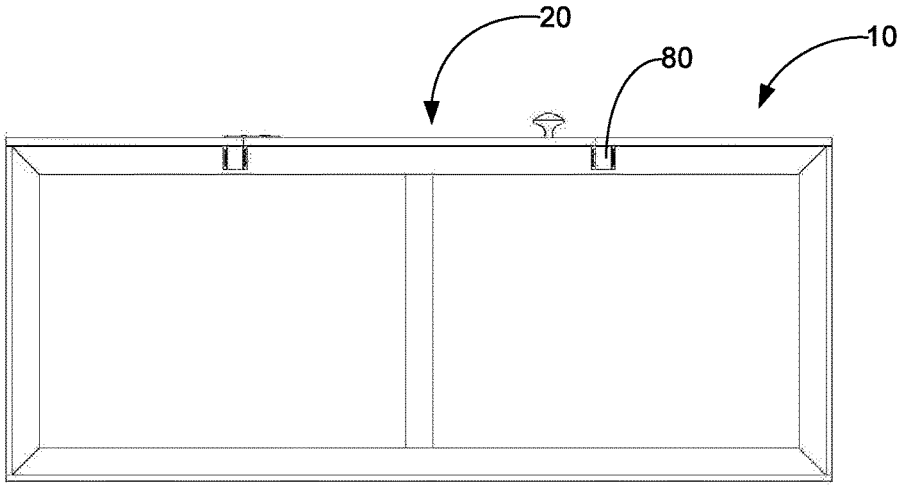

In accordance with the foregoing description, FIG. 1A shows, that in at least some embodiments, the described systems include a collapsible sauna 10 that is configured to be moved to an extended configuration that allows one or more people to use the sauna. Additionally, FIG. 1B shows that, in at least some embodiments, the sauna 10 is configured to be collapsed or otherwise moved to a collapsed position, or a position which allows the sauna to have a smaller footprint for storage and/or for holding fewer people that it does in the extended position. While the described sauna can have any suitable component that allows it to function as described herein, FIG. 1A shows a representative embodiment in which the sauna 10 comprises a door 20 disposed in a collapsible sauna housing 15. Additionally (as discussed below), some embodiments of the sauna comprise one or more sealing mechanisms, guides, means for expanding and/or collapsing the sauna, means for reducing friction between an extension member of the sauna and a floor (or any other suitable supporting surface), benches, and/or heaters.

With respect to the door, the described sauna 10 can comprise any suitable door that allows the sauna to function as intended. Some examples of such doors include, but are not limited to, one or more hinged doors, bi-swing doors, French doors, pocket doors, sliding doors, rolling doors, strip door curtains, bi-fold doors, folding doors, accordion doors, glass doors, ceramic doors, plastic doors, wooden doors, fiberglass doors, polymer doors, and/or other suitable doors (or combination of doors), made from any suitable material or materials, that allow the sauna to function as intended.

The sauna doors 20 can be disposed in any locations that allow the sauna 10 to function as intended. For instance, the door can be disposed in the base member 30, the extension member 35, and/or any other part of the housing 15. In some embodiments, however, the door is disposed in an extension member (discussed below) of the housing. Moreover, in some embodiments, in order to allow a user to enter (at least partially) into the sauna when the sauna is in the collapsed position, the door is disposed at a portion of the extension member that is exposed when the sauna is in the collapsed position (e.g., as shown in FIGS. 1A-1B).

With respect now to the collapsible sauna housing 15, the housing can comprise any suitable component that allows the size of the sauna (e.g., a volume of an internal chamber 25 of the sauna 10) to be increased and decreased when the sauna moves from a collapsed configuration to an extended configuration, and vice versa. In some embodiments, the housing comprises one or more housing pieces that are movably coupled to each other.

While housing 15 can have any suitable number of housing pieces (e.g., 1, 2, 3, 4, 5, 6, 7, or more) that allow the size of the sauna 10 to be varied, FIG. 1A shows an embodiment in which the housing 15 comprises a base member 30 that is configured to remain in place on a supporting surface (e.g., a floor, the ground, and/or any other surface suitable to support the sauna 10) while the extension member 35 is configured to, at least partially, selectively extend from and be nested in (or otherwise moved towards) the base member 30.

Figure 3A:
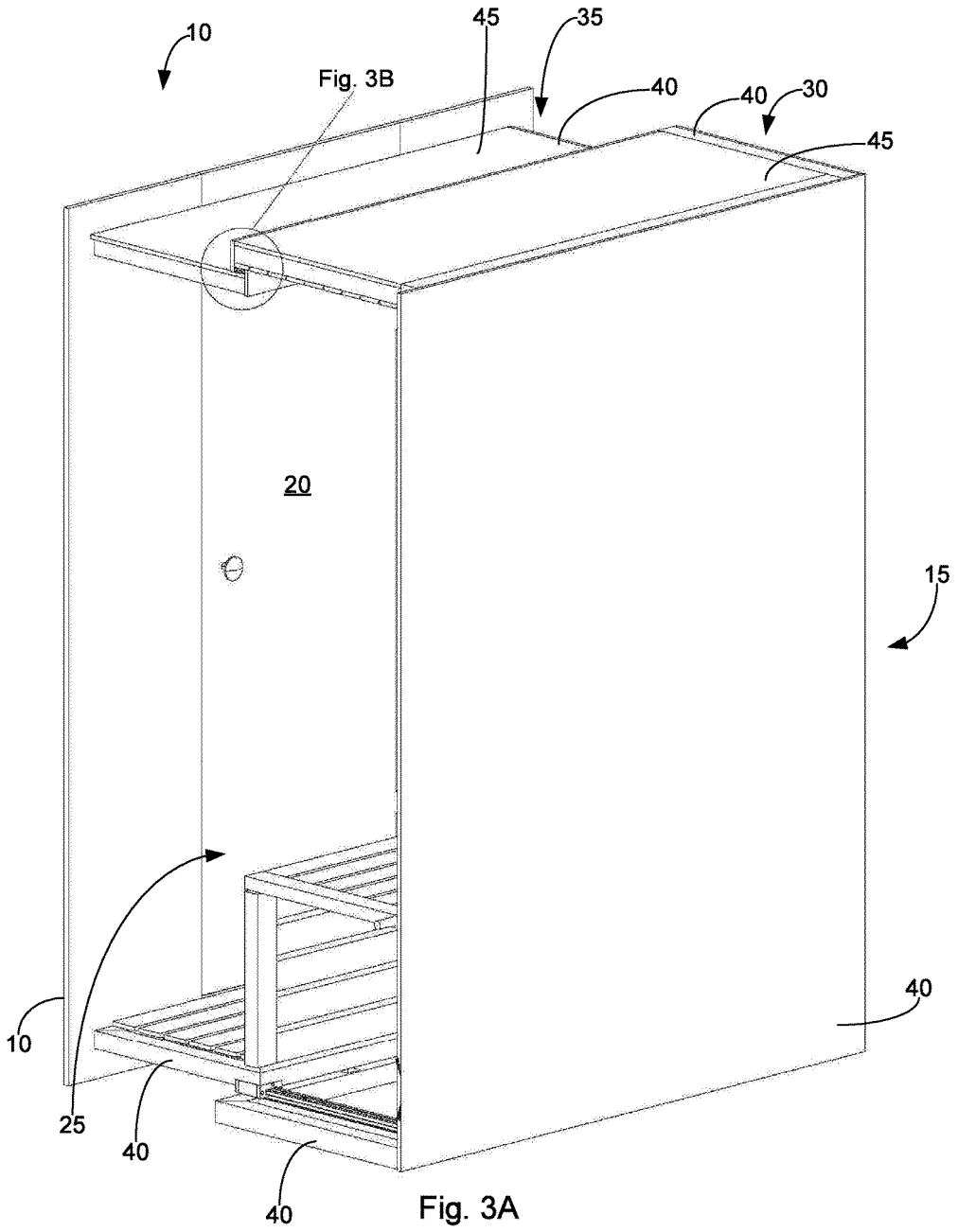
FIG. 3A illustrates a partially cut-away, perspective view of a representative embodiment of the sauna.

The base 30 and extension 35 members of the sauna housing 15 can have any suitable shape that allows the sauna 10 to define an internal chamber that is configured to be varied in size and that otherwise allows the sauna to function as intended. Indeed, in some embodiments, the base and extension members have a shape that is partially cuboidal, partially cylindrical, partially triangular, partially square, partially rectangular, rounded, curved, polygonal, symmetrical, asymmetrical, irregular, and/or any other suitable shape or combination of shapes. By way of non-limiting illustration, FIGS. 1 and 2A-2H show some embodiments in which the base 30 and extension 35 portions are at least partially cuboidal. Specifically, FIGS. 1, 2A-2H, and 3A show some embodiments in which the base 30 and extension 35 portions each comprise 5 walls 40 with an open face, wherein the open faces of the housing portions are faced towards each other to define the sauna chamber 25. Moreover, FIG. 3A shows that, in at least some embodiments, each of the housing pieces comprises a ceiling 45, which thus allows one or more people to enter in, and be mostly (if not completely) surrounded by the sauna 10.

The base 30 and extension 35 portions be any suitable size that allows the sauna 10 to function as intended. Indeed, in some embodiments, the base and extension members are sized such that 1, 2, 3, 4, 5, 6, 7, 8, 9, 10, or more people can sit in the sauna when the sauna is in the extended position, and 0, 1, 2, 3, 4, 5, or more users can sit in the sauna when the sauna is in the collapsed position.

Figure 3B:
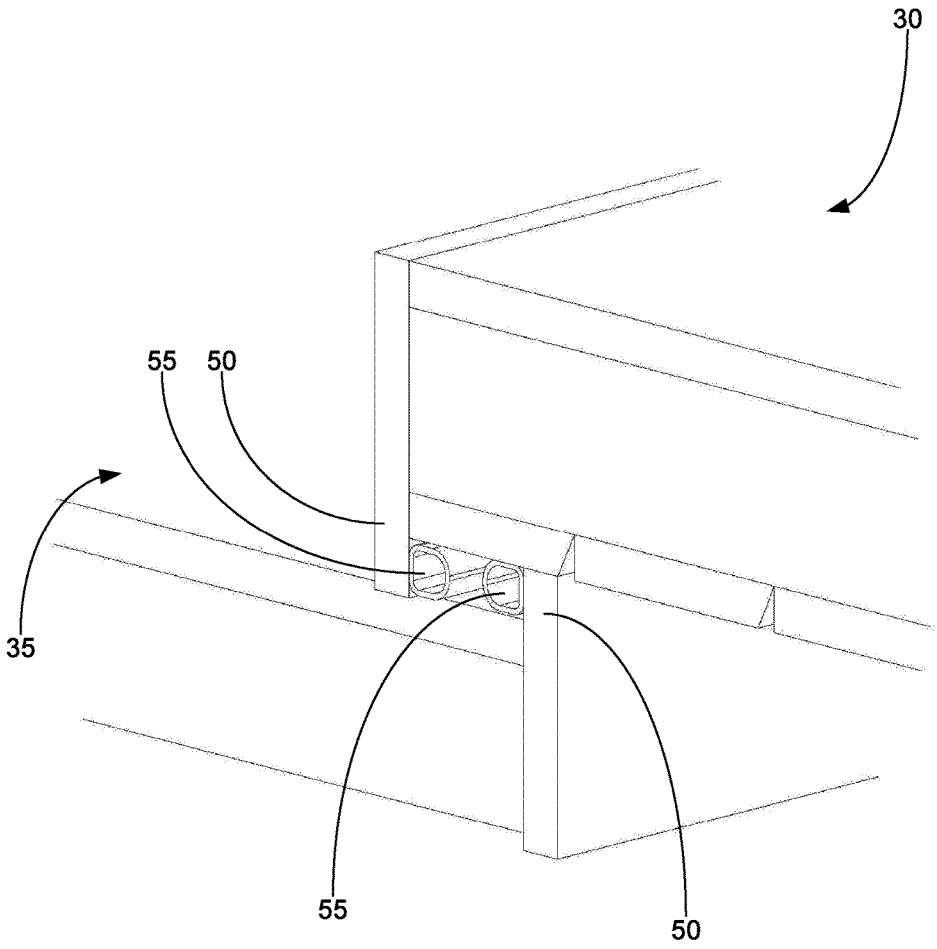
FIG. 3B illustrates an enlarged view of a portion of FIG. 3A.
Figure 4A:
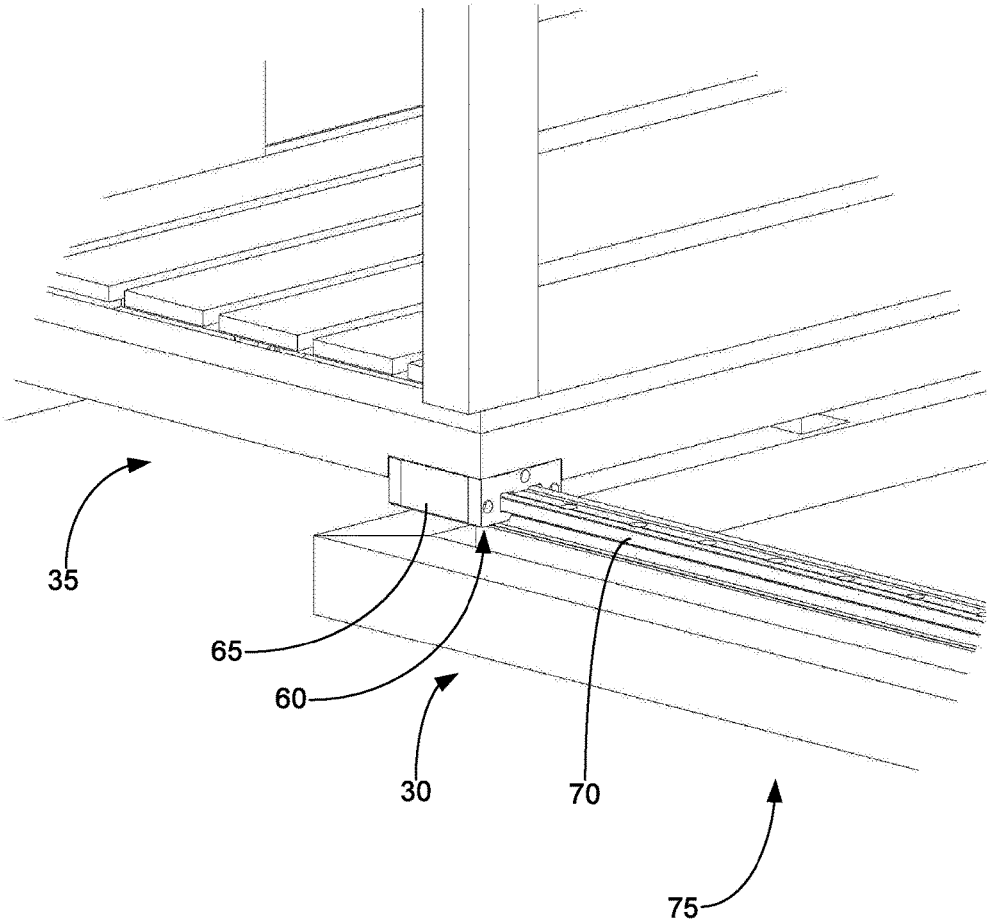
FIG. 4A illustrates a perspective view of a representative embodiment of a guide for use with some embodiments of the sauna.
Figure 4B:
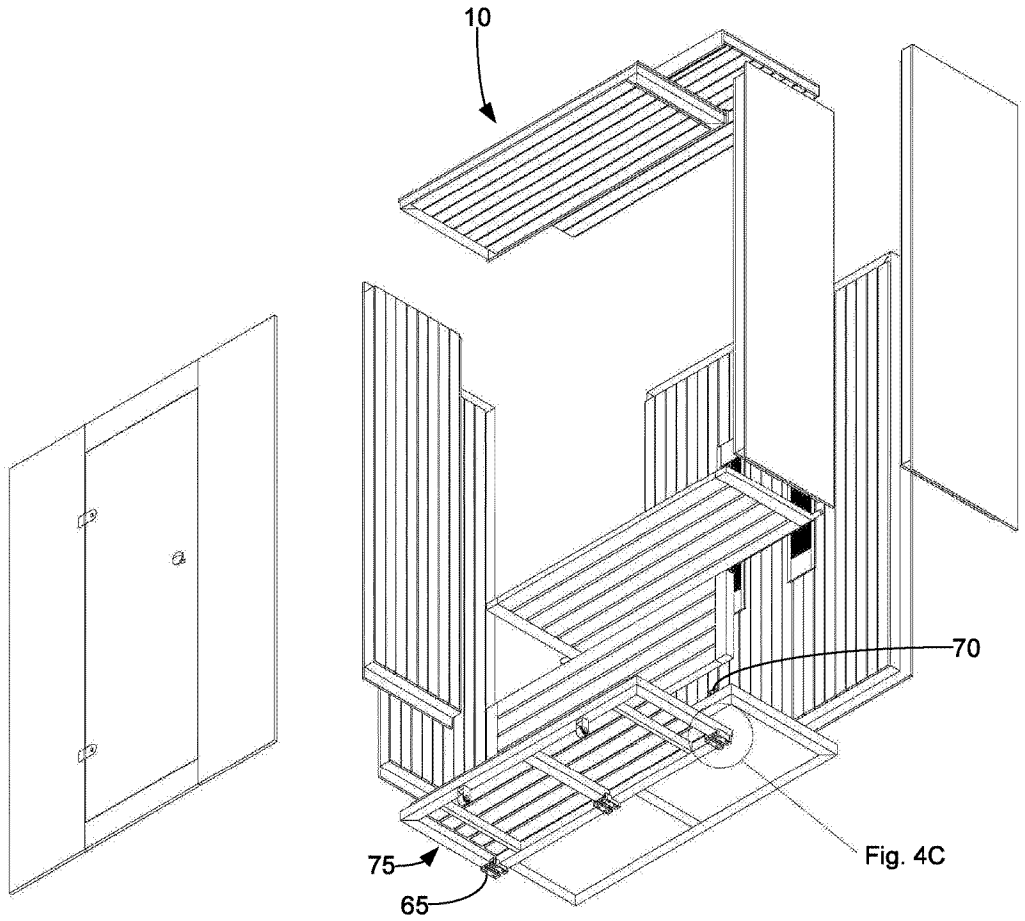
FIG. 4B illustrates an exploded view of a representative embodiment of the sauna.
Figure 4C:
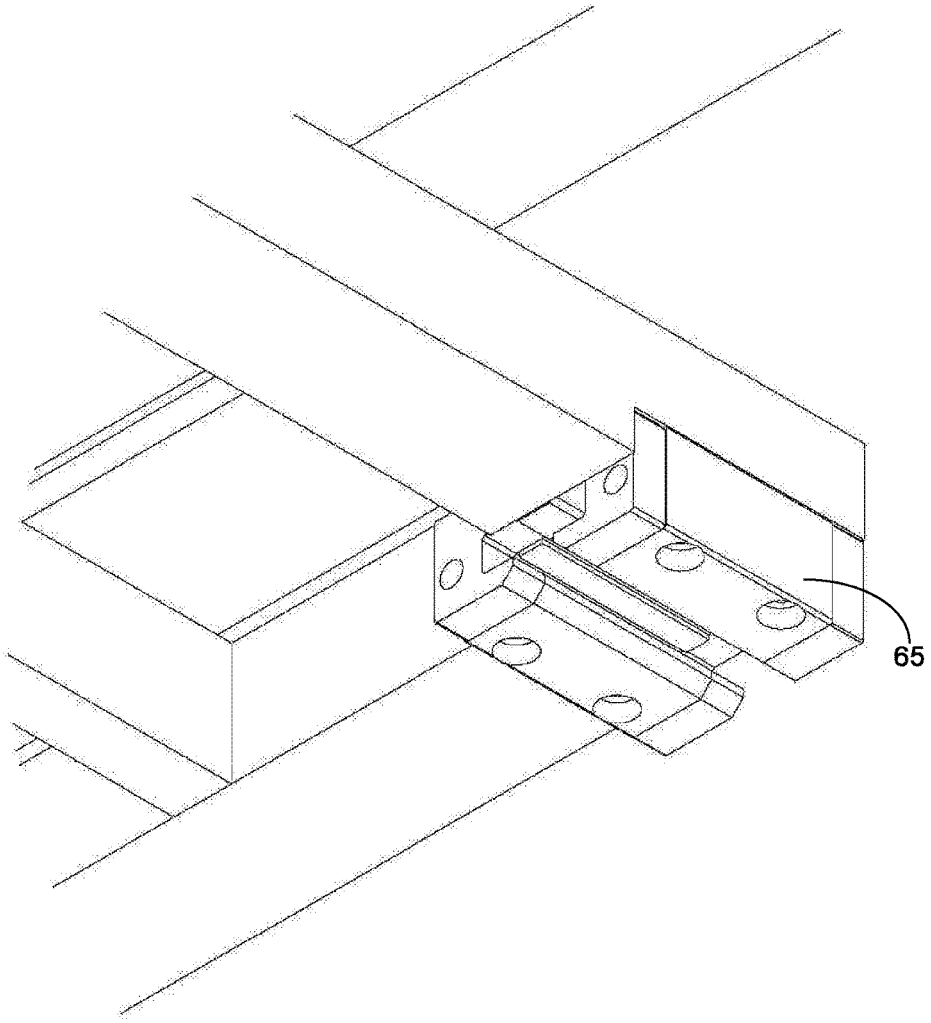
FIGS. 4C-4D illustrate enlarged views of portions of a representative embodiment of the guide.
Figure 4D:
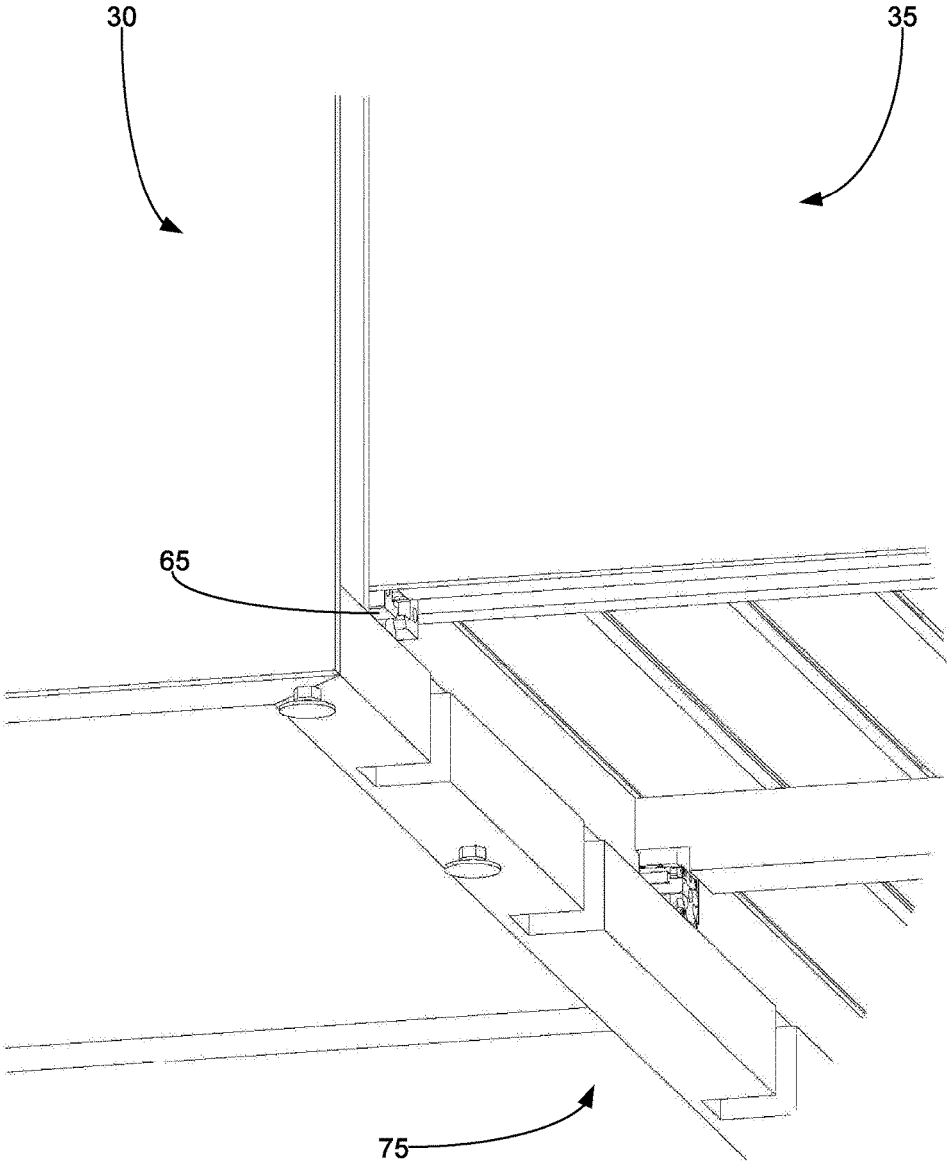
Figure 5A:
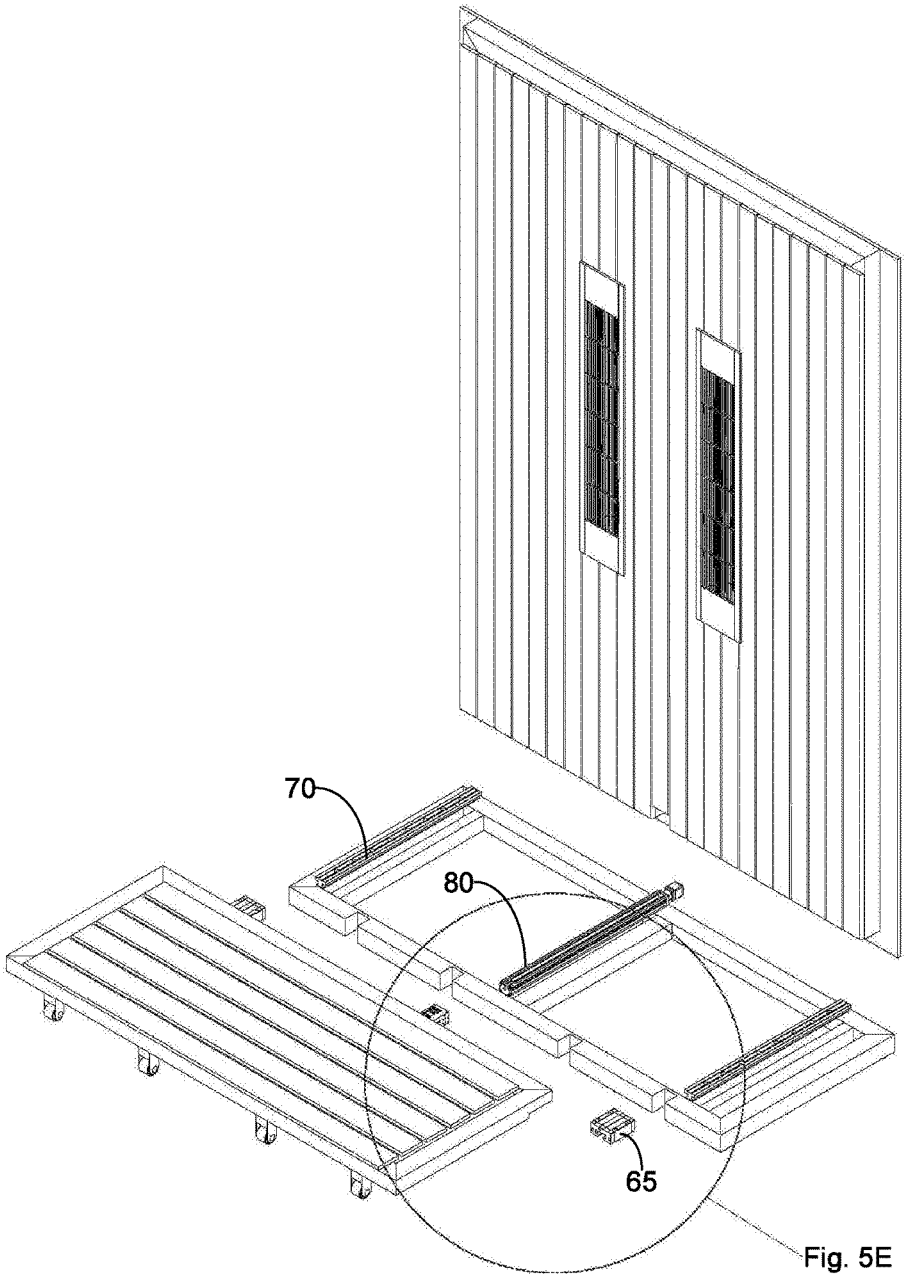
FIGS. 5A-5E illustrate perspective views of a representative embodiment of a drive mechanism for use with some embodiments of the sauna.
Figure 5B:
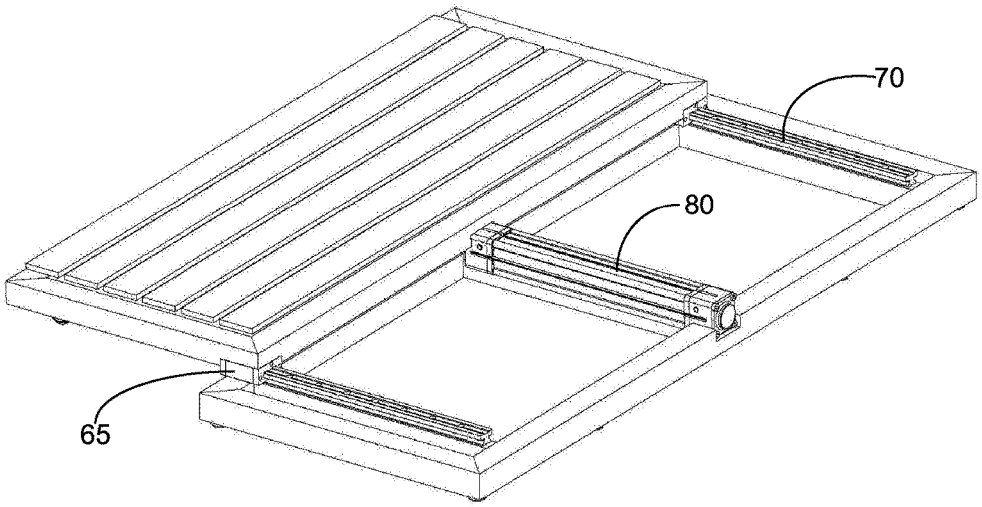
Figure 5C:
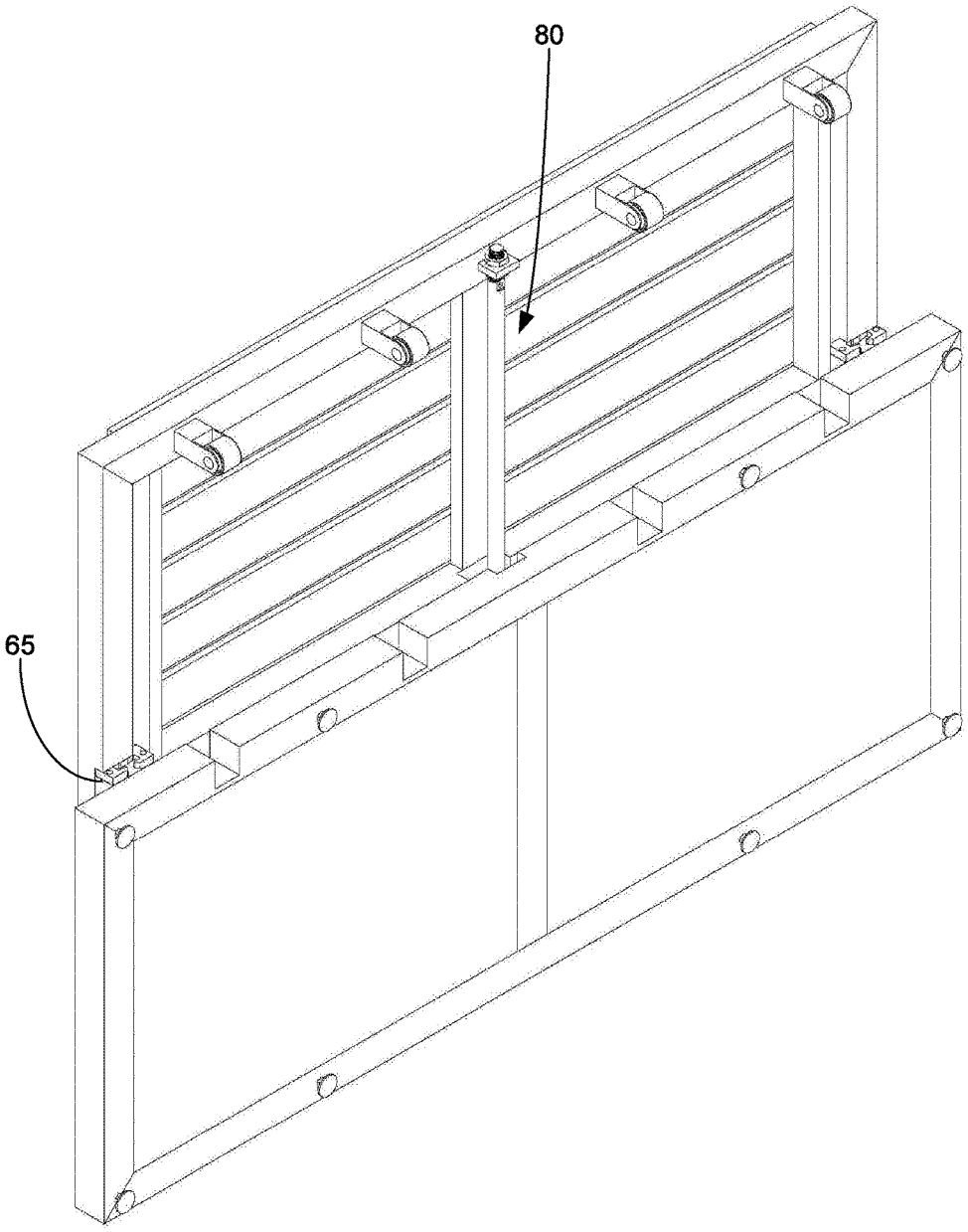
Figure 5D:
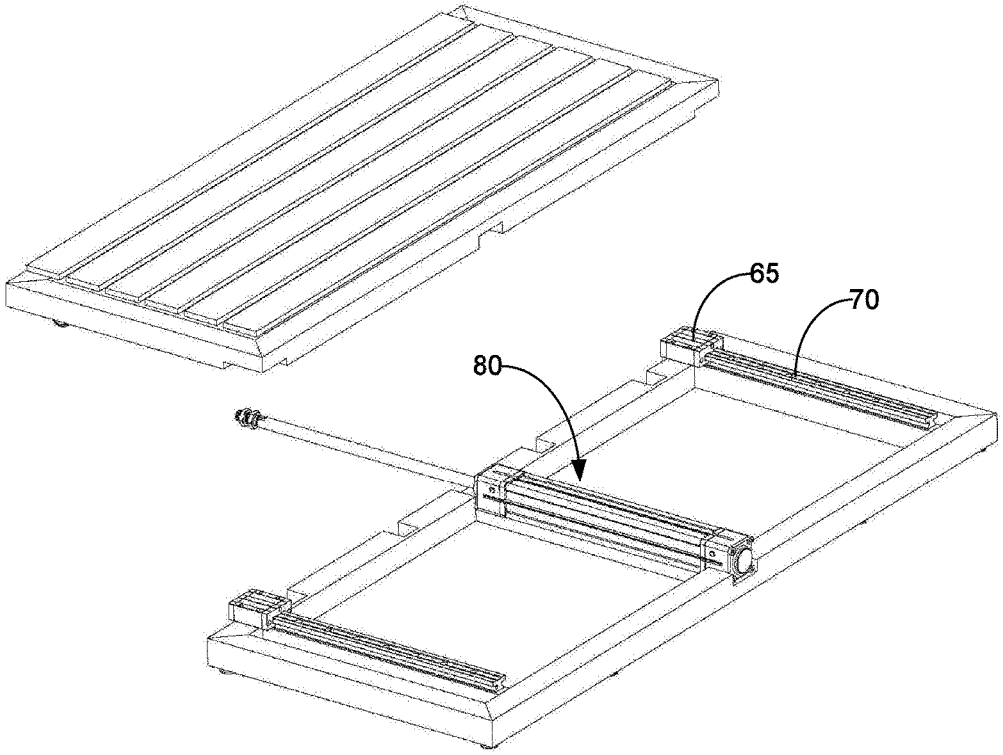
Figure 5E:
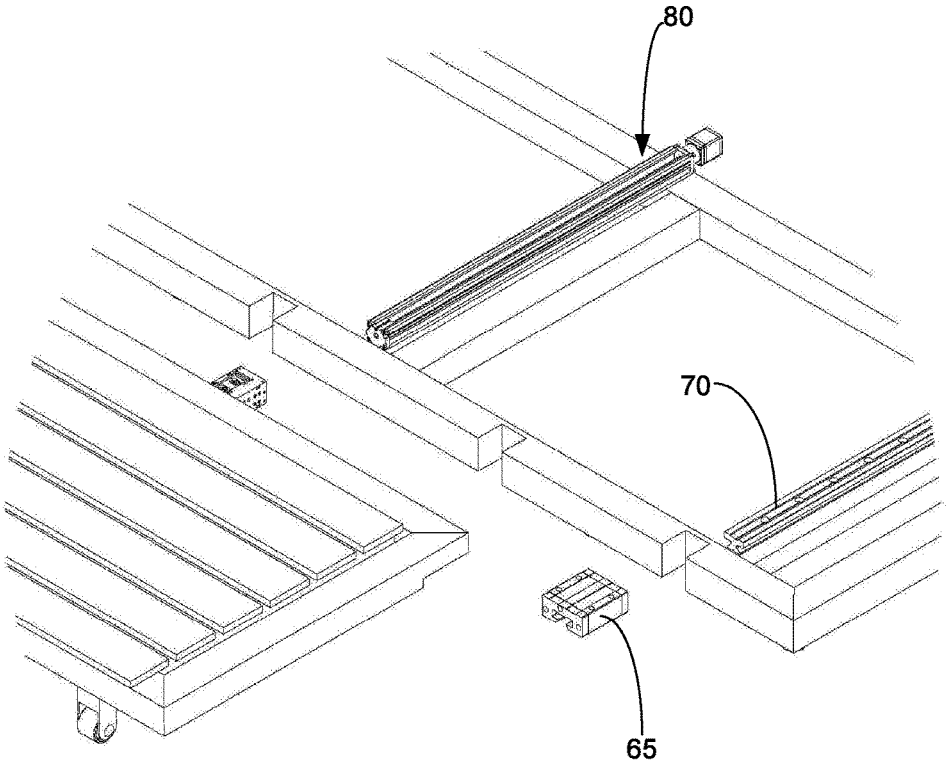

The base 30 and extension 35 portions can be coupled to each other in any suitable manner that allows them to move between the collapsed and extended positions without falling apart. Some examples of suitable mechanisms for connecting the two housing pieces include, without limitation, one or more catches, seals, guides, joints, limits on the means for expanding and/or collapsing the sauna, cables, and/or any other suitable mechanisms.

Where the sauna 10 comprises one or catches, such catches can comprise any suitable component or characteristic that is configured to keep the extension member 35 from separating from the base member 30 when the extension member is moved to the extended position. Some examples of such catches include, but are not limited to, a member (and/or abutment) that is configured to extend from the base and/or the extension member and to catch another portion of the other of the base and/or the extension member, a ratchet mechanism (including, without limitation, a linear ratchet mechanism), a detent mechanism, and/or any other suitable mechanism. By way of illustration, FIGS. 3A and 3B shows an embodiment in which both the base 30 and the extension 35 comprise a lip 50 that are configured to catch each other (e.g., as the sauna is moved towards its maximum extended position) and prevent the base and extension from separating when the sauna 10 is moved to the extended position.

Where the sauna 10 comprises one or more seals between 2 or more of the various components of the sauna housing 15, the sauna can comprise any suitable seal and/or other suitable sealing mechanism that is configured to prevent some moisture and/or heat from escaping from the sauna (e.g., from a seam between two or more pieces of the sauna housing). Some examples of such sealing mechanisms comprise one or more seals, close tolerances between the various pieces of the housing, liners, and/or any other suitable mechanism configured to help prevent moisture and/or heat from escaping between pieces of the sauna housing. By way of illustration, FIG. 3B shows that, in some embodiments, the sealing mechanism comprises one or more seals 55. While FIG. 3B shows an embodiment comprising D-seals, any other suitable type or types of seals can be used, including, without limitation, one or more lamellar seals, foil vapor barriers, scrims, tapes, and/or other suitable seals. Indeed, in some embodiments, the sauna comprises a lamellar seal fitted along an edge of the extension member 35, such that lamellae of the seal face the base member 30 (and/or another portion of the housing 15).

Where the sauna 10 comprises a guide that couples one or more components of the sauna housing 15 (e.g., the base 30 and extension 35) together, the sauna can comprise any suitable type of guide, including, without limitation, one or more linear slides, extension slides, slides, linear guides, linear guideways, cam roller guides, linear rails, linear bearing rails, rails, tracks, drawer rails, drawer slides, drawer runners, magnetic guides, and/or other suitable guides. Nevertheless, FIGS. 4A-4D illustrate some embodiments in which the sauna 10 comprises one or more guides 60 which each comprise one or more carriages 65 and/or corresponding rails 70.

Where the sauna 10 comprises one or more guides 60, the guide rails can be disposed in any suitable location, including, without limitation, being between two or more pieces of the sauna housing 15 (e.g., the base 30 and the extension 35) at a top portion, a bottom portion, a side portion (e.g., left side, right side, front side, back side, and/or another side), a middle portion, one or more corners, and/or in any other suitable location (or combinations of locations) of the sauna. By way of non-limiting illustration, FIGS. 4A-4D show some embodiments in which the sauna 10 comprises one or more guides 60 disposed at a bottom portion 75 of the sauna 10.

Additionally, where the sauna 10 comprises guides 60, such guides can have any suitable characteristic. Indeed, in some embodiments, the guides have a relatively high tolerance and a relatively low coefficient of friction to prevent the extension member 35 from binding with the base member 30 (and/or another part of the housing 15) as the extension is moved with respect to the base member.

With respect now to the means for expanding and/or collapsing the sauna 10, the sauna can be moved between the collapsed position and the extended position in any suitable manner, including, without limitation, by being moved manually and/or mechanically. Where the sauna is extended and collapsed manually, the extension member 35 of the housing 15 can be moved in any suitable manner. Some examples of means for extending and/or collapsing (or otherwise reducing the size of) the sauna, include, but are not limited, to one or more drive mechanisms; and/or handles, handholds, and/or other suitable surfaces configured to allow a user to place pressure on a portion of the sauna while the user is pulling and/or pushing on the extension.

Where the sauna 10 comprises a drive mechanism, the drive mechanism can comprise any component that allows it to cause the extension member 35 of the housing 15 to be extended from and/or be retracted towards the housing's base member 30. Some examples of such drive mechanisms, include, but are not limited to, one or more linear guides (including, without limitation, electrically operated linear guides), ball screws (such as those used to adjust car seats), linear actuators, mechanical actuators, hydraulic actuators, pneumatic actuators, piezoelectric actuators, electro-mechanical actuators, linear motors, telescoping linear actuators, rodless actuators, stepper motors, servomechanisms, and/or other suitable mechanisms that are capable of extending and/or retracting the extension member. By way of non-limiting illustration, FIGS. 5A-5E illustrate some embodiments in which sauna (not entirely shown in such FIGS.) comprises a linear actuator 80 (e.g., a hydraulic cylinder, a pneumatic cylinder, etc.). Indeed, in some embodiments, the sauna comprises one or more pneumatic cylinders and/or air compressors. A non-limiting example of such a cylinder is a cylinder comprising end-position damping and that is configured to operate at a pressure range of 0.5 to 15 bar, or any subrange thereof (e.g., between about 1 and about 8 bar).

Where the sauna 10 comprises one or more drive mechanisms (e.g., a linear actuator 80 or otherwise), the drive mechanisms can be disposed in any suitable location, including, without limitation, at a top portion, a bottom portion, a side portion (e.g., left side, right side, front side, back side, and/or another side), a middle portion, one or more corners, and/or in any other suitable location (or combinations of locations) of the sauna. Indeed, in some embodiments, the drive mechanisms are placed in such a location that they are configured to allow one or more walls of the extension 35 to slide parallely past one or more adjacent walls of the base 30 or to otherwise reduce and/or prevent the extension from binding up against the base as the extension moves.

In some embodiments, as shown in FIGS. 5A-5E, the drive mechanism (e.g., linear actuator 80) is disposed in a middle portion of the sauna 10. In some other embodiments, which are not illustrated, the sauna comprises two or more drive mechanisms that are disposed on opposing portions of the sauna, which may include, without limitation, a right and a left side of the sauna, a top and bottom of the sauna, a front and back of the sauna, opposing corners of the sauna, and/or any other suitable locations that help prevent the extension from jamming against the base due to an imbalance in the forces applied to the extension (and/or other part of the housing 15). Moreover, in some embodiments, in order to prevent the one portion of the sauna housing from binding against another as the extension is extended and/or retracted, the sauna comprises two or more drive mechanisms that are synchronized with each other such that each moves a portion of the sauna the same distance as do the other drive mechanisms.

Figure 6A:
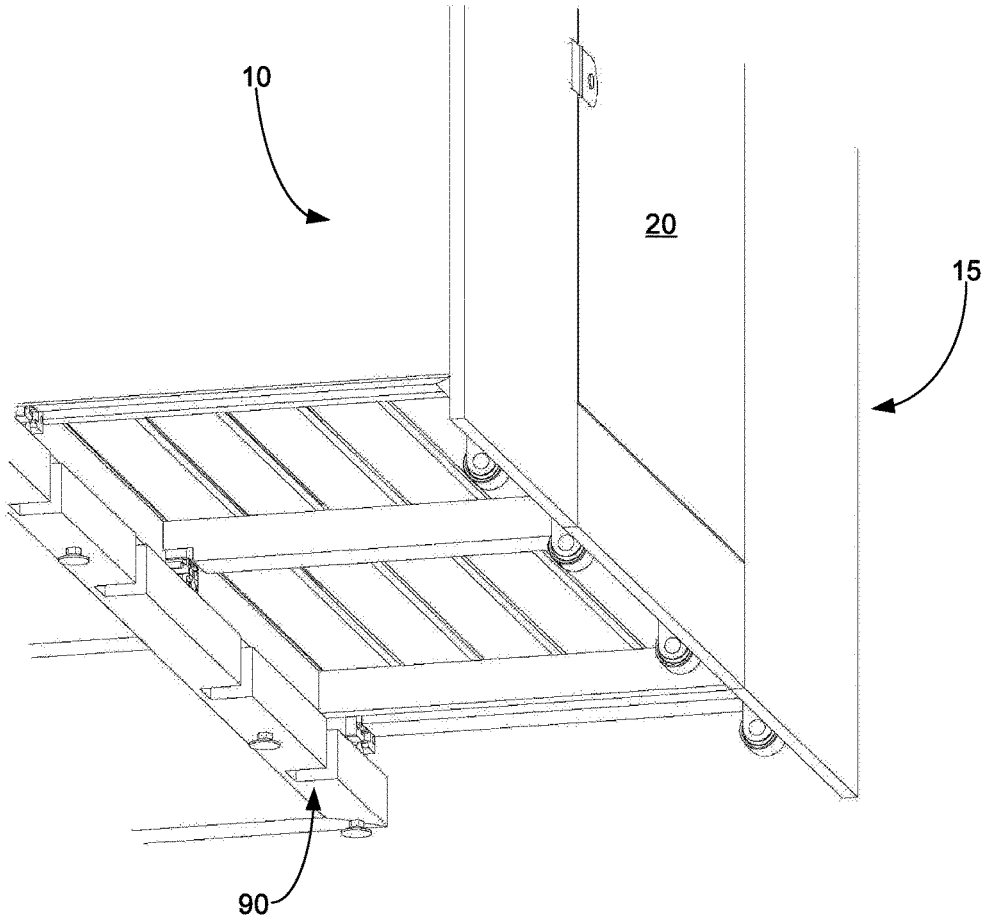
FIGS. 6A-6B illustrate perspective views of the sauna comprising wheels, in accordance with some embodiments.
Figure 6B:
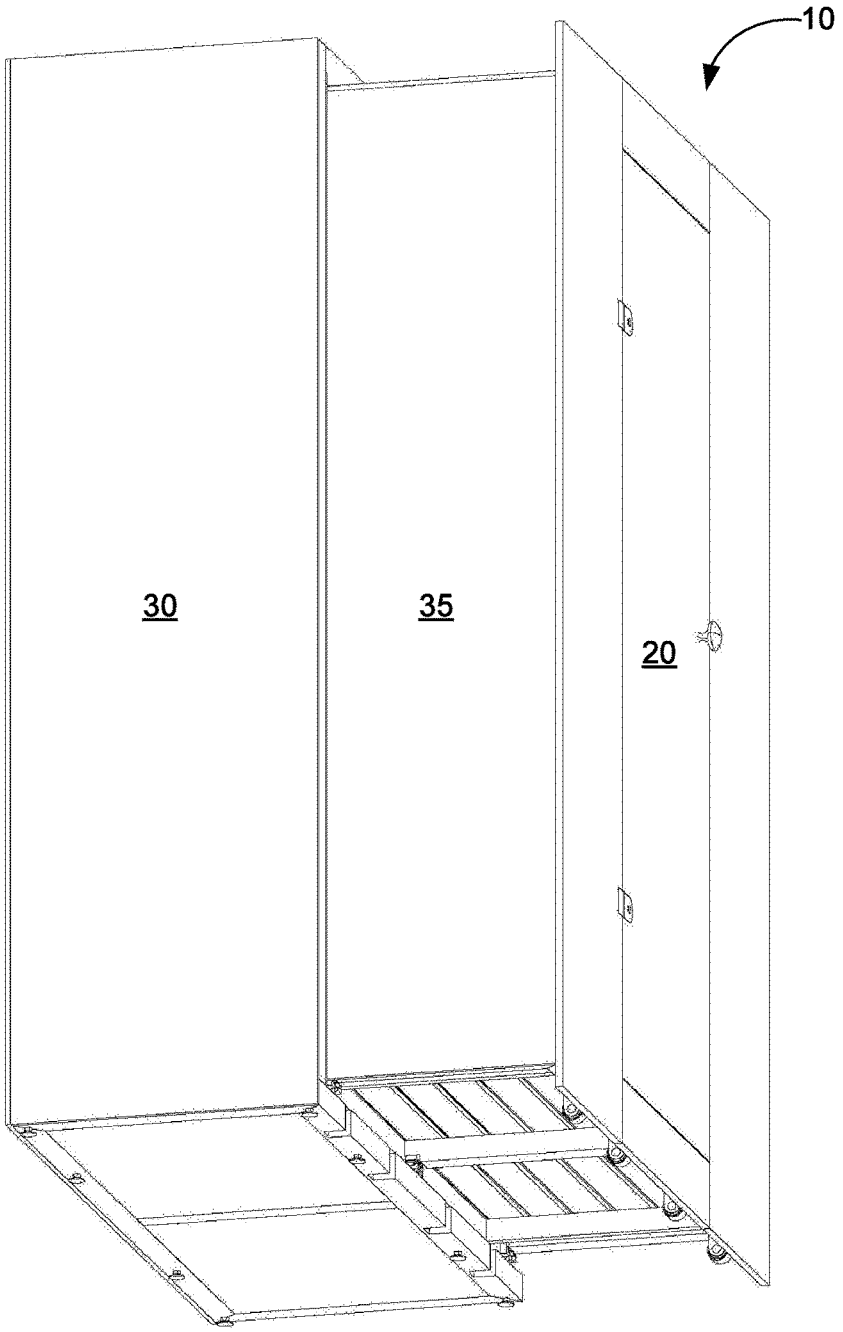
Figure 7B:
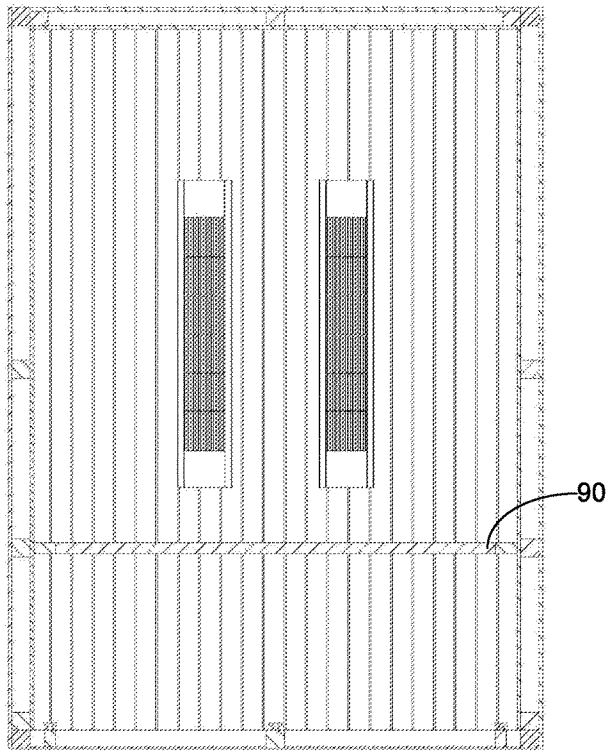
FIG. 7B illustrates a front cross-sectional view of the sauna of FIG. 7A taken along line C-C.
Figure 7A:
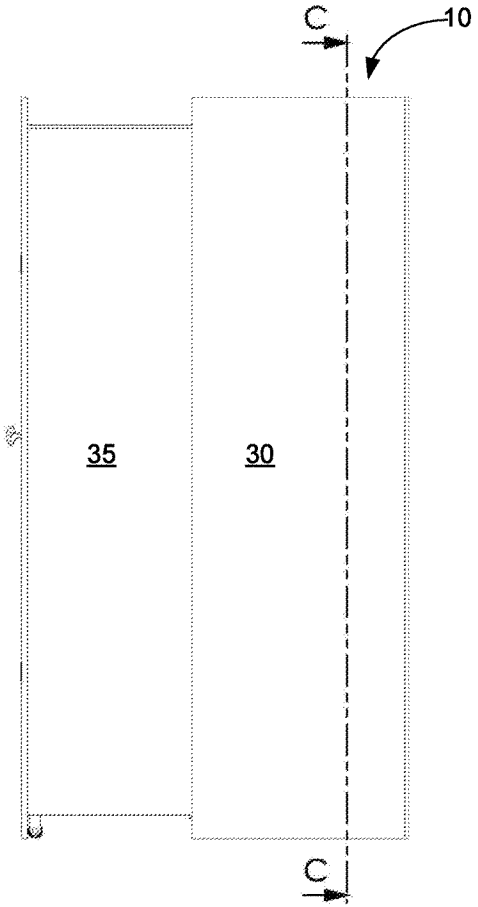
FIG. 7A illustrates a side view of a representative embodiment of the sauna.
Figure 7D:
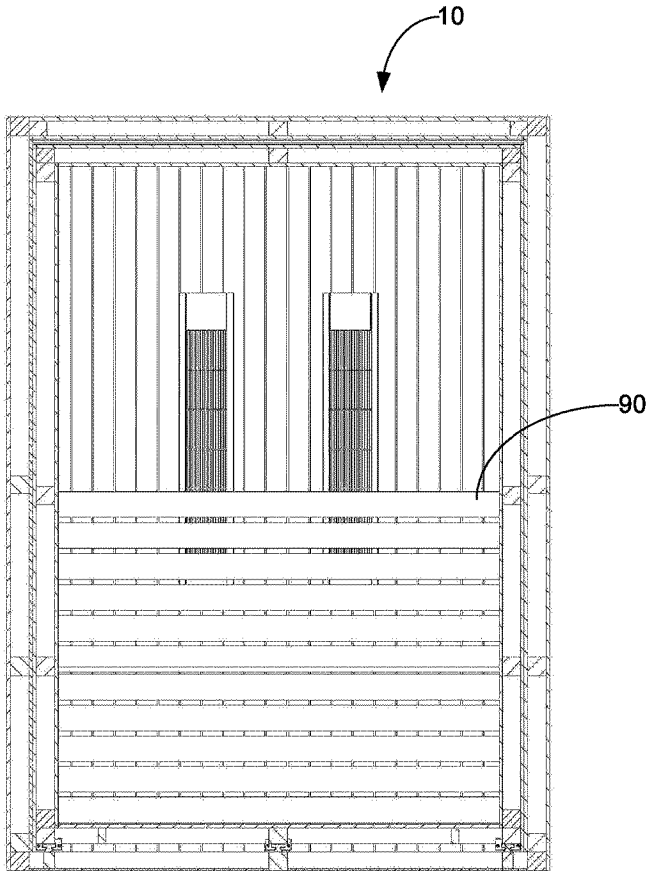
FIG. 7D illustrates a front cross-sectional view of the sauna of FIG. 7C taken along line C-C.
Figure 7C:
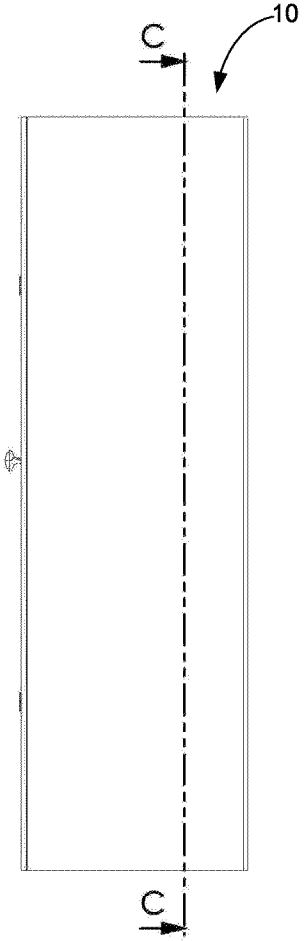
FIG. 7C illustrates a side view of a representative embodiment of the sauna.
Figure 7E:
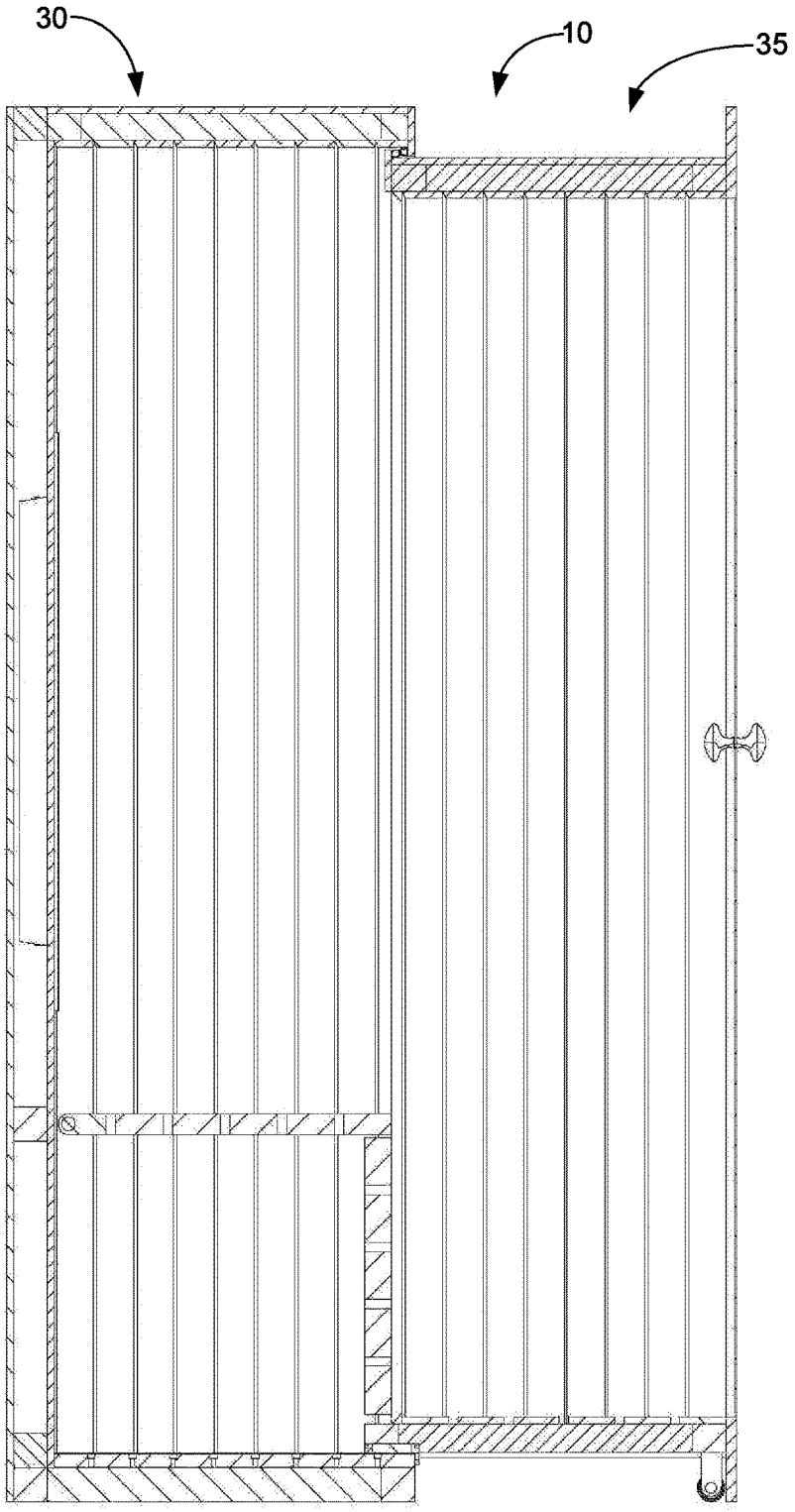
FIGS. 7E-7G illustrate side cross-sectional views of a representative embodiment of the sauna.
Figure 7F:
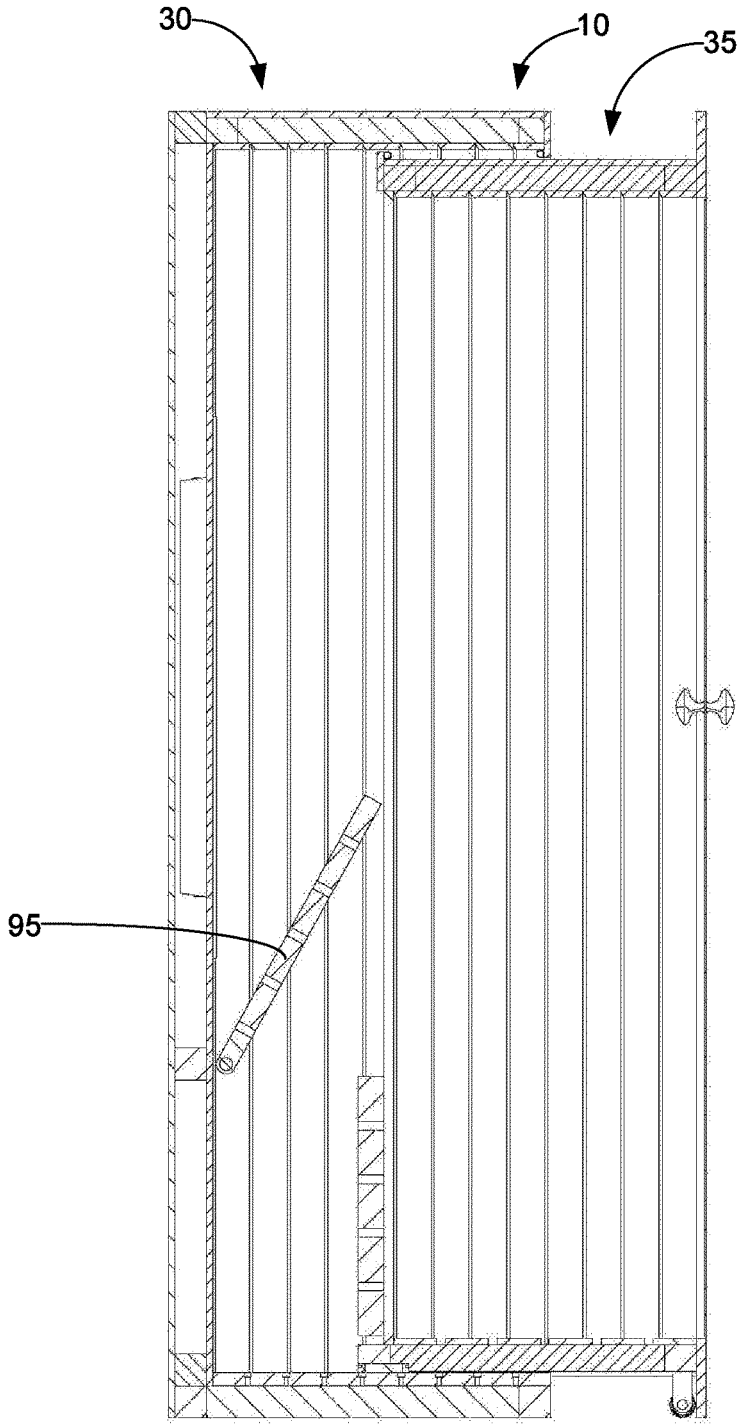
Figure 7G:
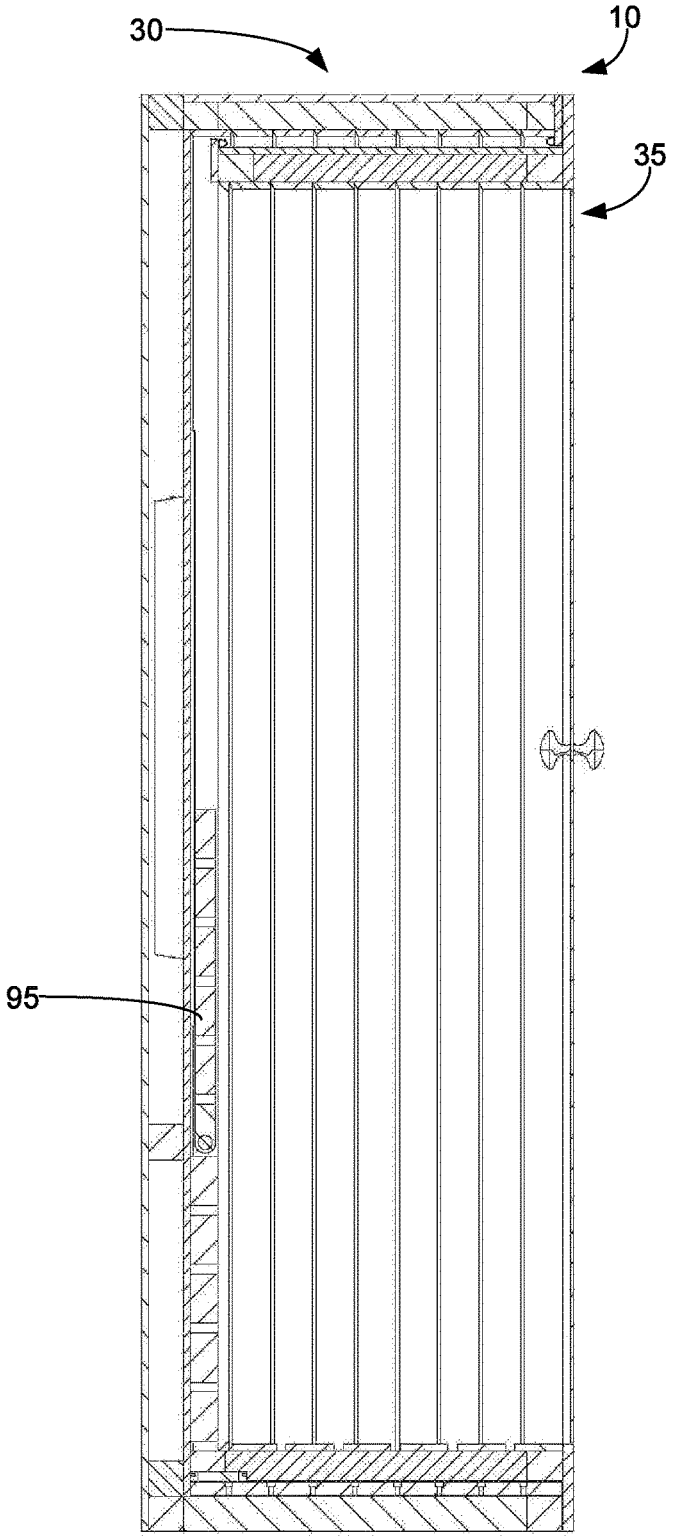

With reference now to the means for reducing friction between the extension member 35 of the sauna 10 (and/or another portion of the housing 15) and a support surface (e.g., a floor, the ground, and/or otherwise), the sauna can comprise any suitable characteristic and/or component that allows the extension member (and/or any other suitable part of the sauna housing) to be moved across the support surface with relatively little friction. Some examples of such friction reducing means include, but are not limited to, one or more wheels, rollers, sliders (e.g., surfaces comprising a material having a low coefficient of friction), skis, and/or other suitable components that are configured to allow a piece of the housing (e.g., the extension) to move relatively easily across a supporting surface. In some non-limiting illustrations, FIGS. 6A-B show that, in some embodiments, one or more portions of the housing 15 (e.g., the extension member 35) comprise one or more wheels 85, which are configured to absorb forces generated by the weight of the extension (and/or other components of the housing 15) when the sauna is in the extended position so that the forces are not unduly transferred through the guides 80 to the base member 30 (and/or another portion of the housing).

The friction reducing means (e.g., wheels 85) can be disposed in any suitable location and can have any suitable characteristic that allow the sauna to function as intended. In one non-limiting example, the wheels are disposed laterally on the housing 15 (e.g., at a lateral edge of the extension 35) to help disperse weight. In another non-limiting example, some embodiments of the sauna optionally have one or more slots 95 (e.g., as illustrated in FIG. 6A) that are configured to receive and/or hide the wheels 85 when the sauna 10 is in the collapsed configuration. In still another non-limiting example, while the position of some wheels with respect to the extension member 35 is fixed in some embodiments, in other embodiments, the distance between the wheels and the extension member (e.g., an undersurface of the extension member) is adjustable—thus allowing the wheels to be adjusted to accommodate a variety of support surfaces.

As previously stated, some embodiments of the described sauna 10 comprise one or more sitting surfaces. In such embodiments, the sauna can comprise any suitable sitting surface, including, without limitation, one or more benches, seats, chairs, bleachers, and/or other surfaces that can support a sitting user. By way of illustration FIGS. 7B and 7D-7G show some embodiments in which the sauna 10 comprises a bench 90.

While the sitting surfaces in the sauna 10 can comprise any suitable characteristic, in some embodiments, one or more of the sitting surfaces in the sauna are configured to slide, fold, collapse, and/or otherwise move as the sauna moves between the extended the collapsed positions, and vice versa. While this movement of such a sitting surface can be accomplished in any suitable manner, FIGS. 7D, 7E-7G, and 8A-8B show some embodiments in which a sitting surface 95 of the bench is configured to fold (hindgedly or otherwise) to allow the bench 90 to move as the extension member 35 is extended and/or retracted.

The described sauna 10 can be heated in any suitable manner. Some non-limiting examples of suitable means for heating the sauna, include, but are not limited to, a steam generator, a stove, a fire, a traditional heater, an infrared heater, and/or any other heating unit or units that are suitable for use with the sauna.

Figure 8A:
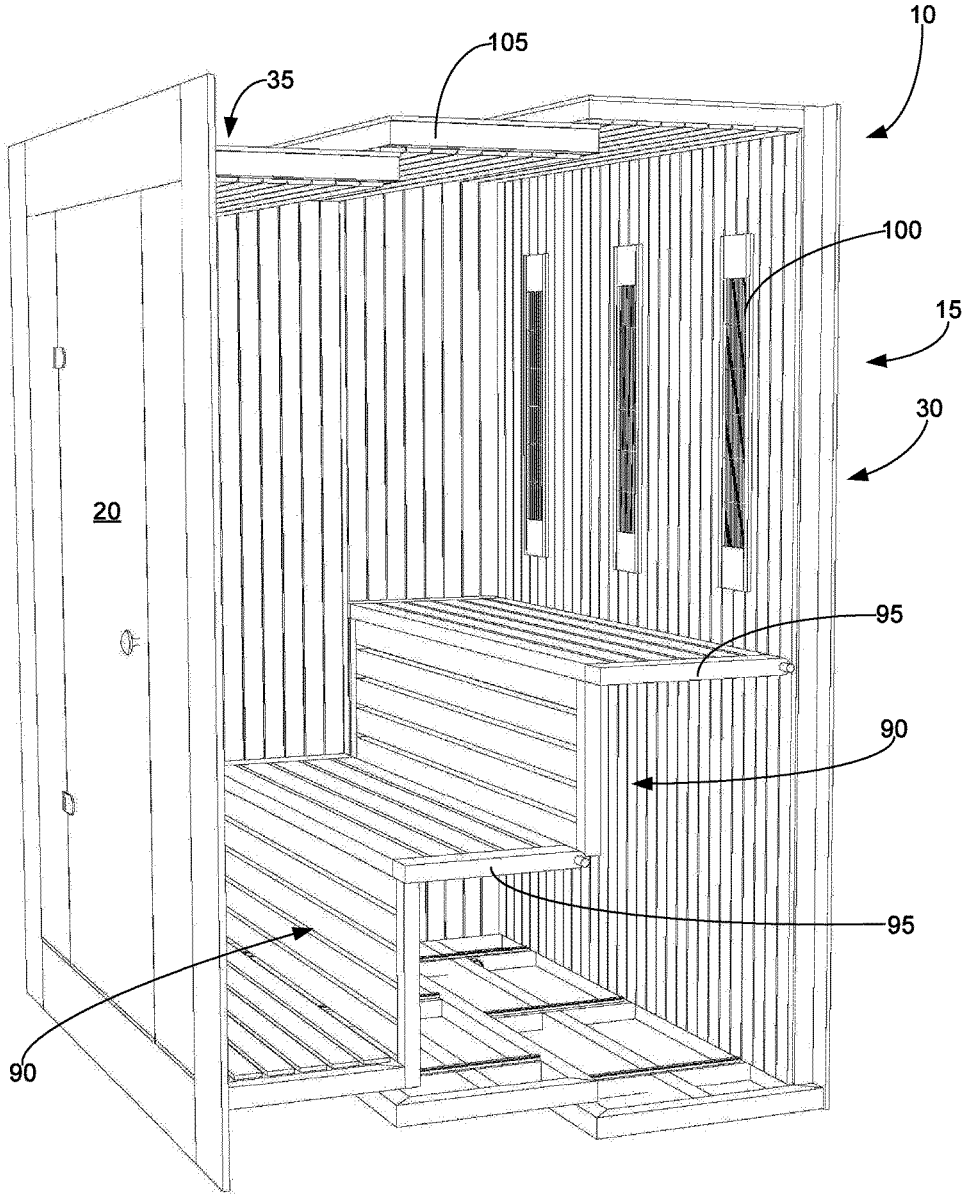
FIGS. 8A-8B illustrate prospective, cross-sectional views of the sauna comprising an additional extension member in accordance with some embodiments.
Figure 8B:
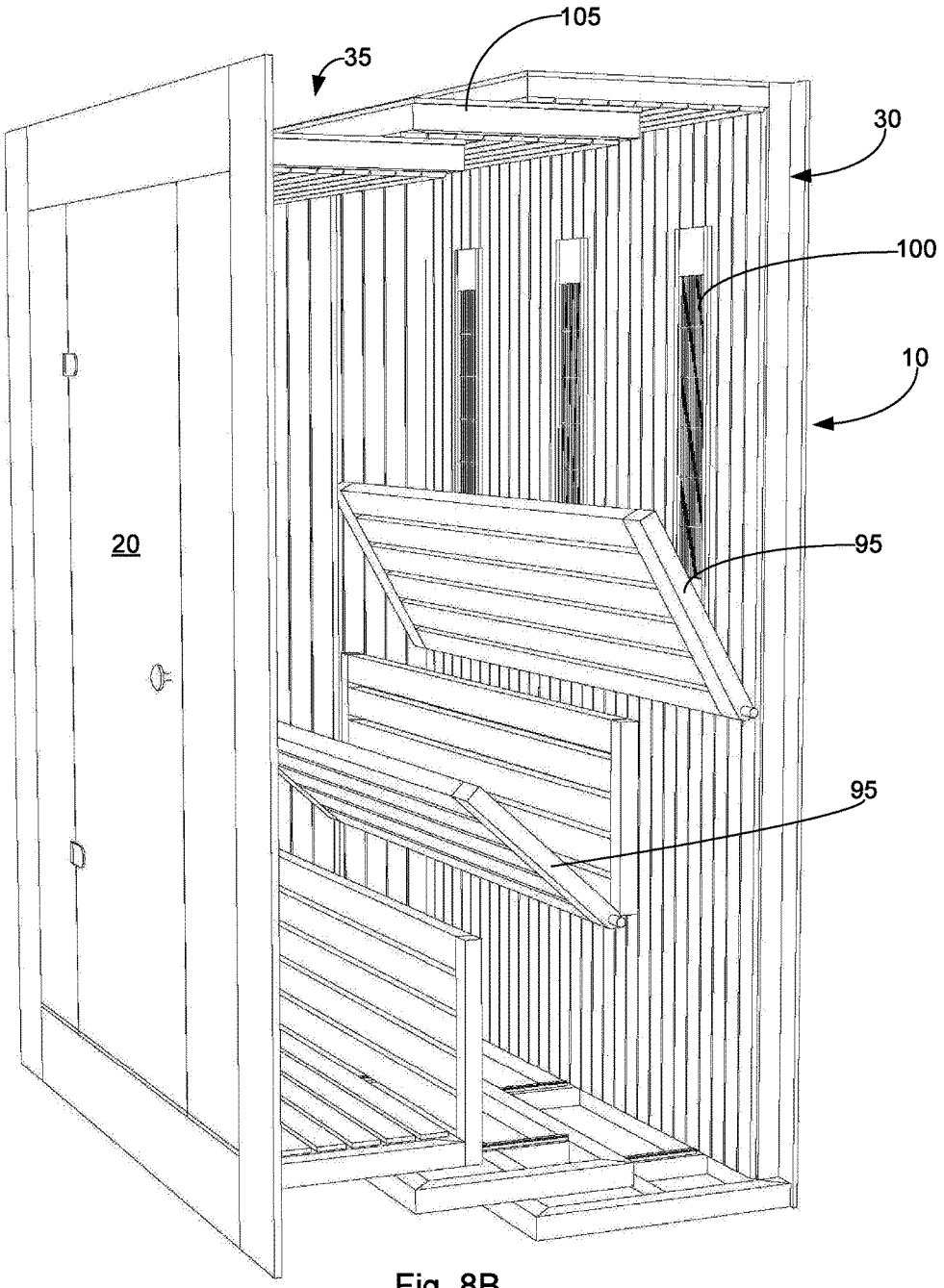

The heater can be located in any suitable location, including, without limitation, outside of the sauna, in the base member 30, in the extension member 35, and/or in any other suitable portion of the sauna. By way of non-limiting illustration, FIGS. 8A-8B show that, in some embodiments, heater vents 100 are disposed in the base member 30 of the sauna housing, with the heater (not directly shown) also being disposed in the base member.

In addition to the aforementioned features, the described sauna 10 can be modified in any suitable manner that allows the size of the sauna's internal chamber 25 to be increased for use and decreased for storage (and/or use by 1 user or a relatively small number of users). In one example, in addition to the base member 30 and the extension member 35, the housing 15 comprises one or more additional extension members. In this regard, the housing can comprise 1, 2, 3, 4, 5, 6, 7, 8, or more additional extension members.

Where the sauna housing 15 comprises one or more additional extension members, the additional pieces of the housing can be disposed in any suitable location. In one example, one or more additional extension members are configured to extend between the extension member 35 and the base member 30 (e.g., when the sauna is in the extended position). In such embodiments, the various portions of the housing can be organized in any suitable manner with respect to each other. Indeed, in some embodiments, a portion of one or more of the additional extension members is sized and shaped so as to be able to nest within the extension member, and such that a portion of the base member is configured to nest within the one or more additional extension members when the sauna 10 is in the collapsed position. In accordance with some other embodiments, however (and as illustrated in FIGS. 8A-8B), a portion of the extension member 35 is configured to slidably fit within one of the one or more additional extension members 105, and the one or more additional extension members are configured to slidably fit within a portion of the base member 30.

Figure 9A:
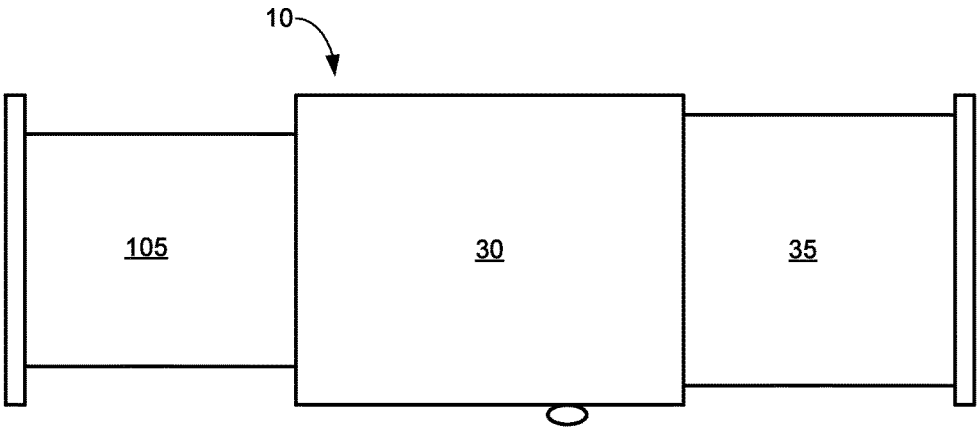
FIG. 9A illustrates a top view of a representative embodiment of the sauna comprising an extension member as well as an additional extension member, wherein the sauna is in the extended configuration.
Figure 9B:
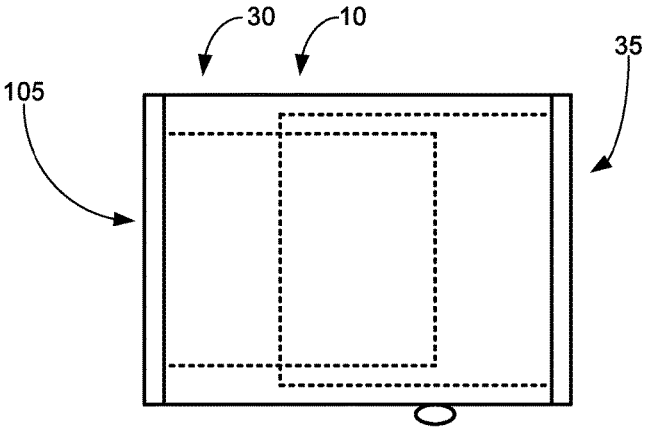
FIG. 9B illustrates a top view of the sauna of FIG. 9A, wherein the sauna is in the collapsed configuration in accordance with some embodiments of the invention.
Figure 10A:
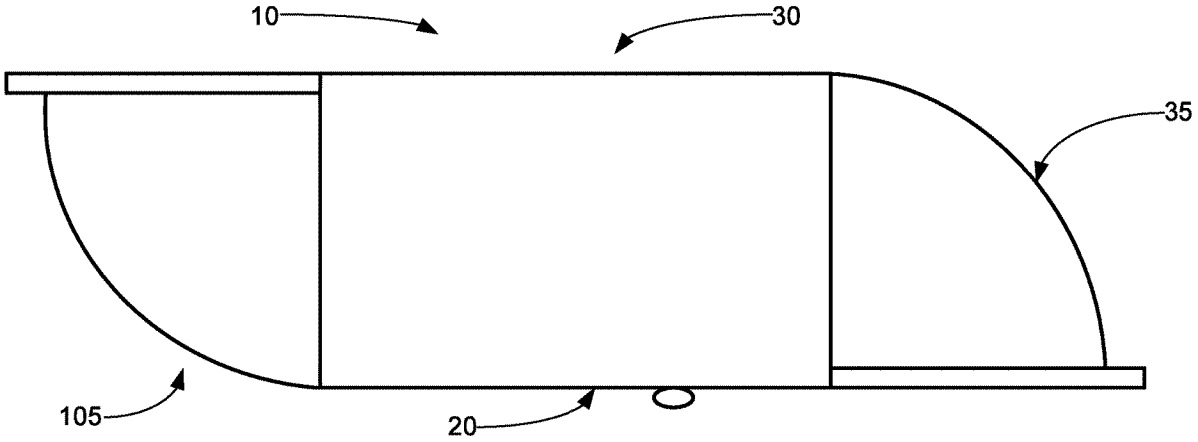
FIGS. 10A-11B illustrate top views of some embodiments of the sauna wherein the sauna comprises a pivotally connected extension member.
Figure 10B:
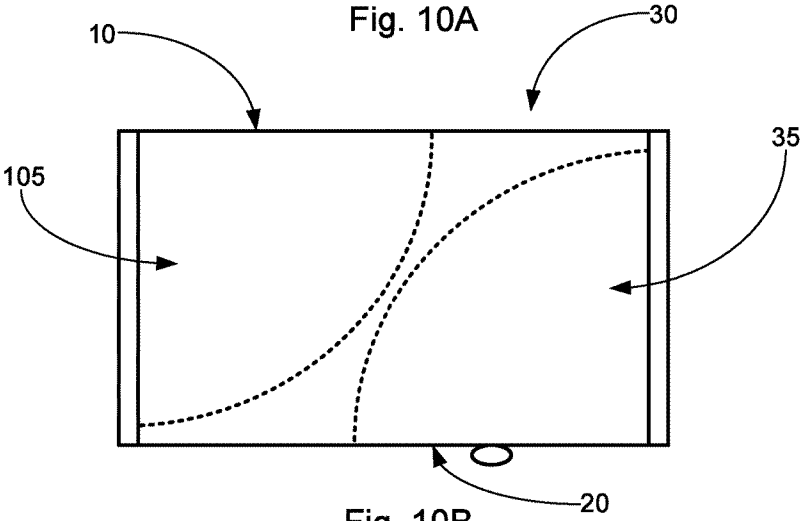
Figure 11A:
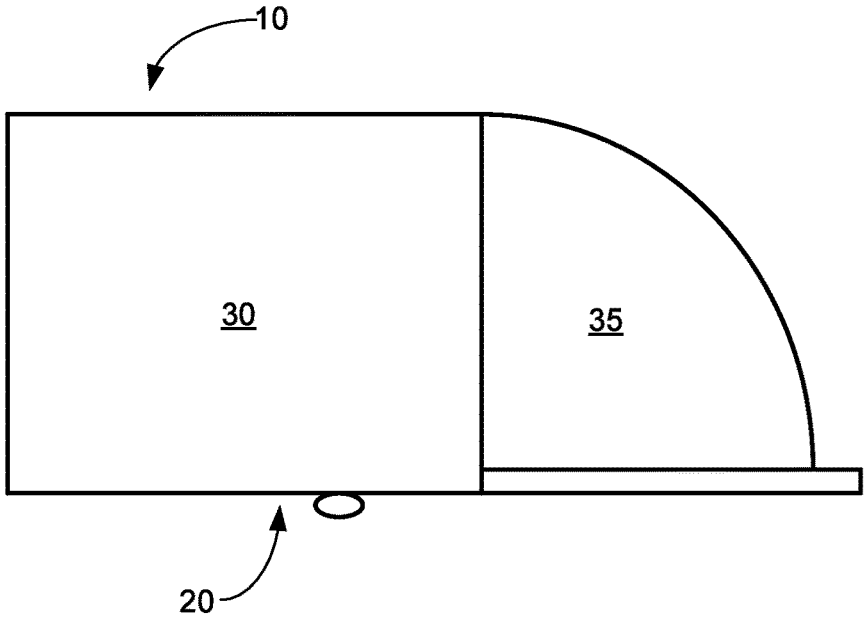
Figure 11B:
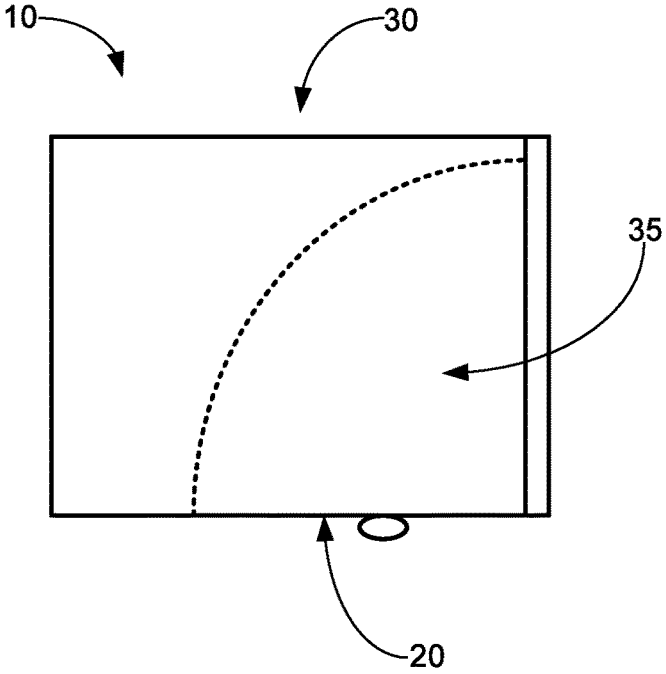
Figure 12A:
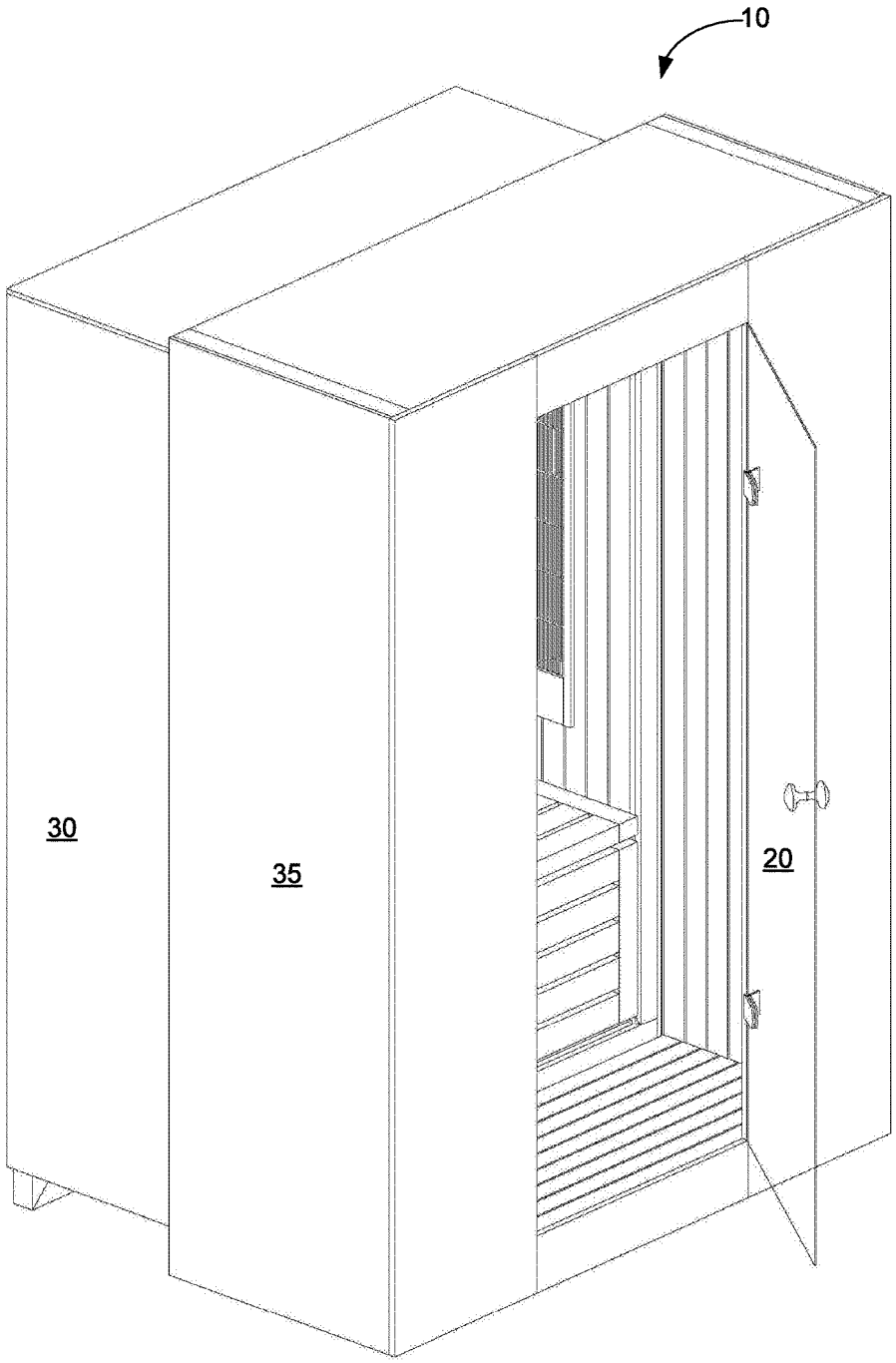
FIGS. 12A-12D respectively illustrate several views of a representative embodiment of the sauna in which the extension member is configured to extended over a base member.
Figure 12B:
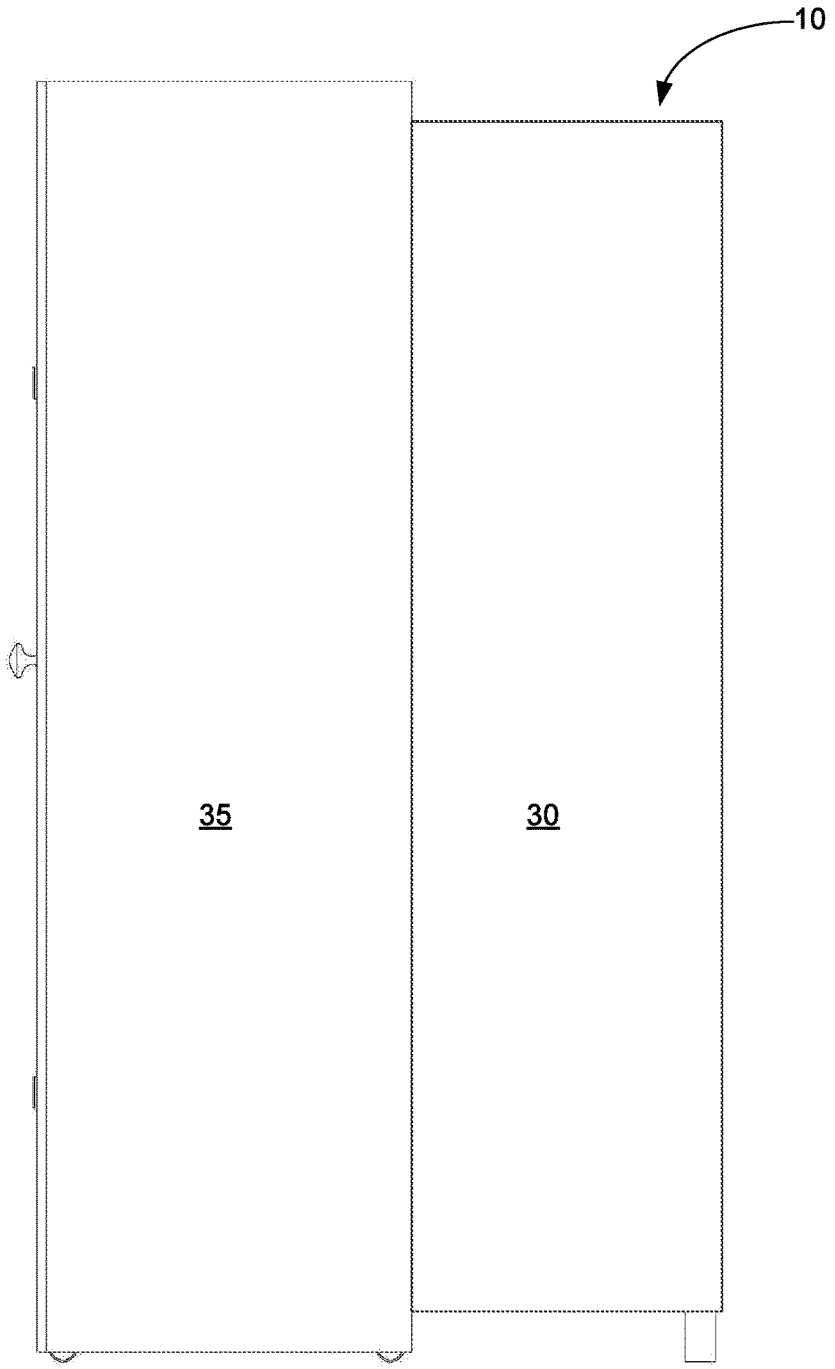
Figure 12C:
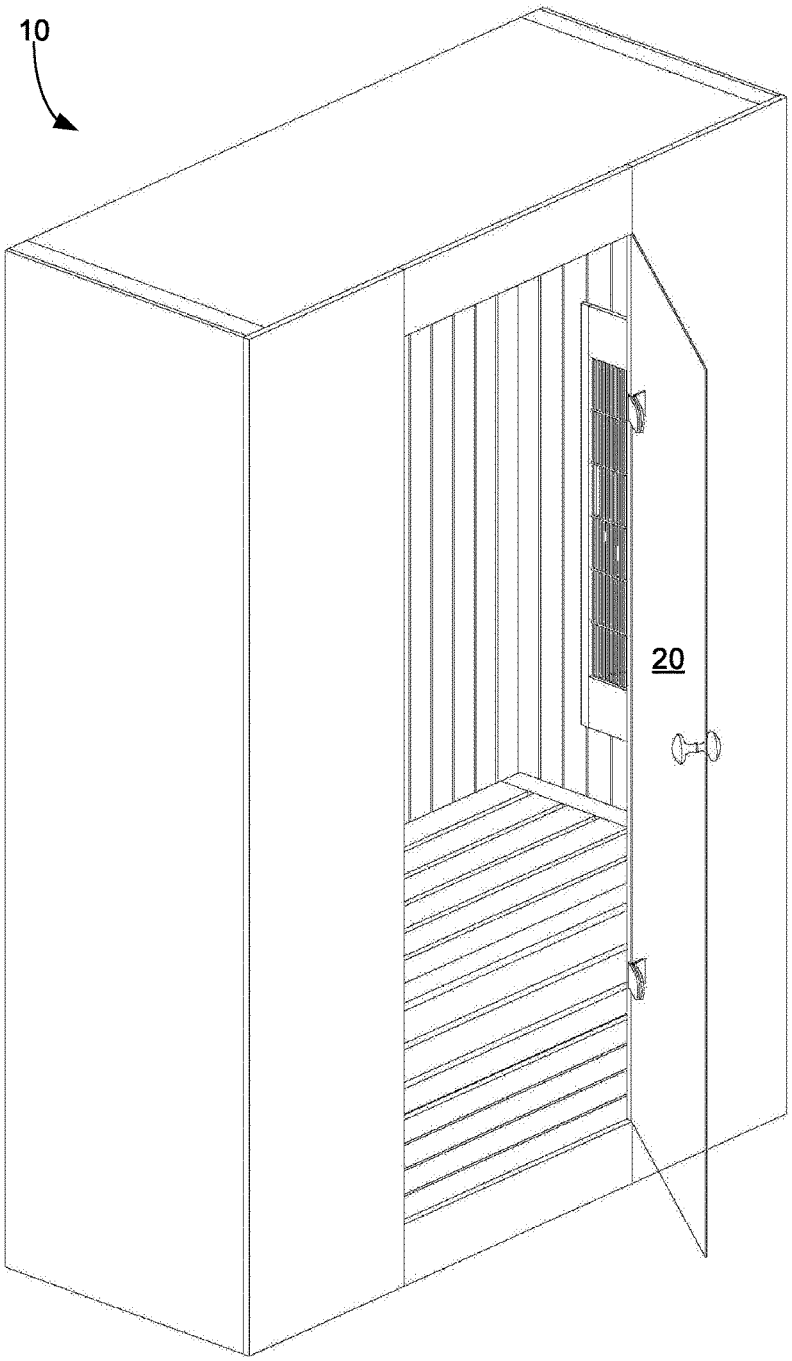
Figure 12D:
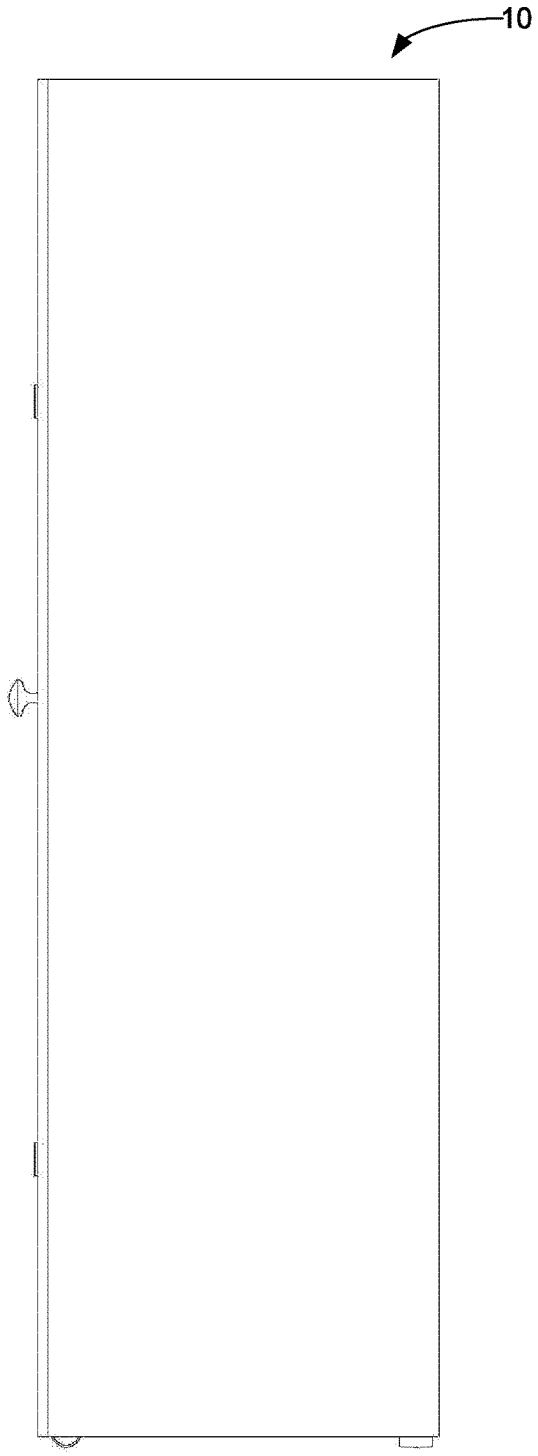
Figure 13A:
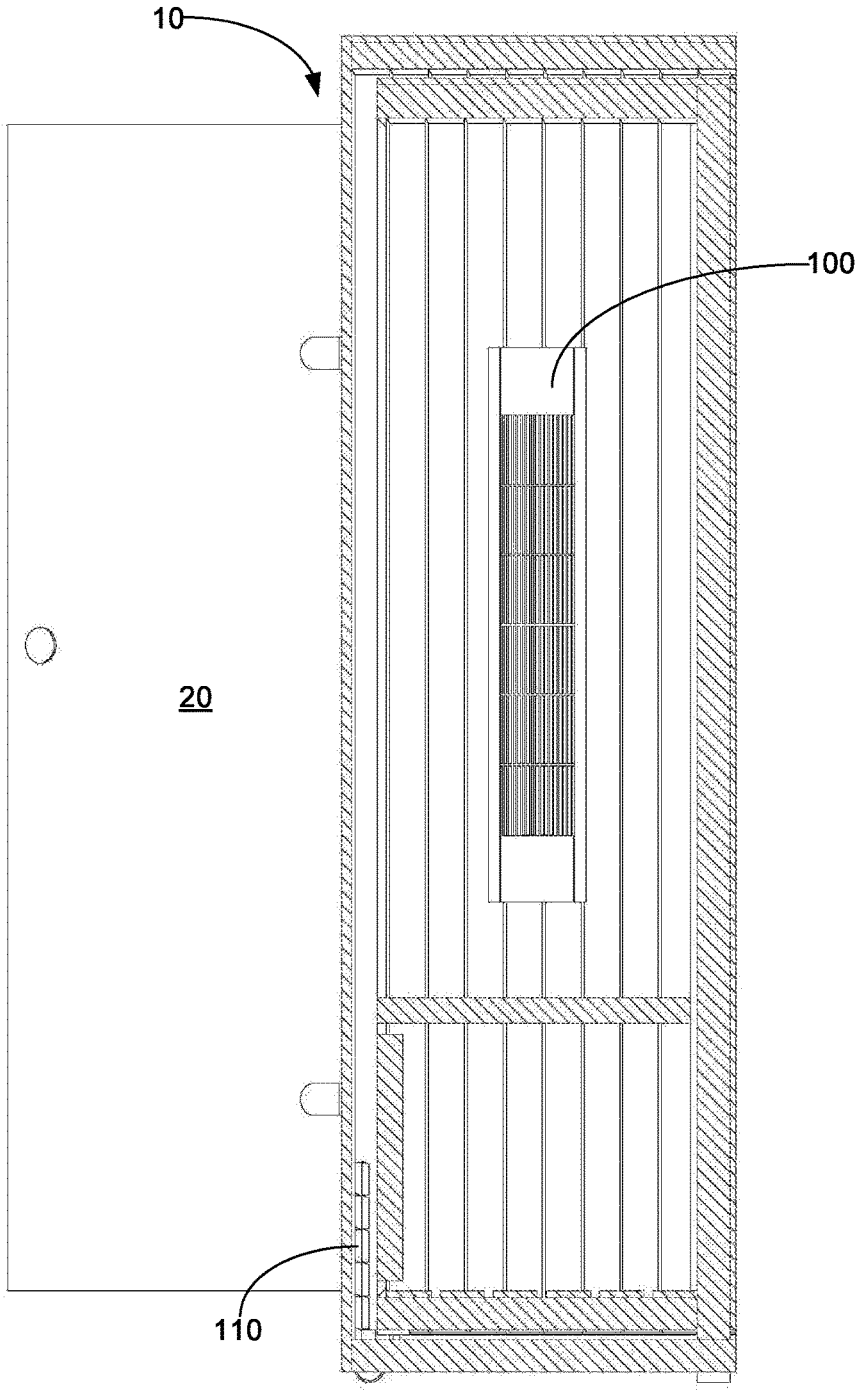
FIGS. 13A-13D illustrate side cross-sectional views of a representative embodiment of the sauna comprising a collapsible piece of flooring in accordance with some embodiments of the invention.
Figure 13B:
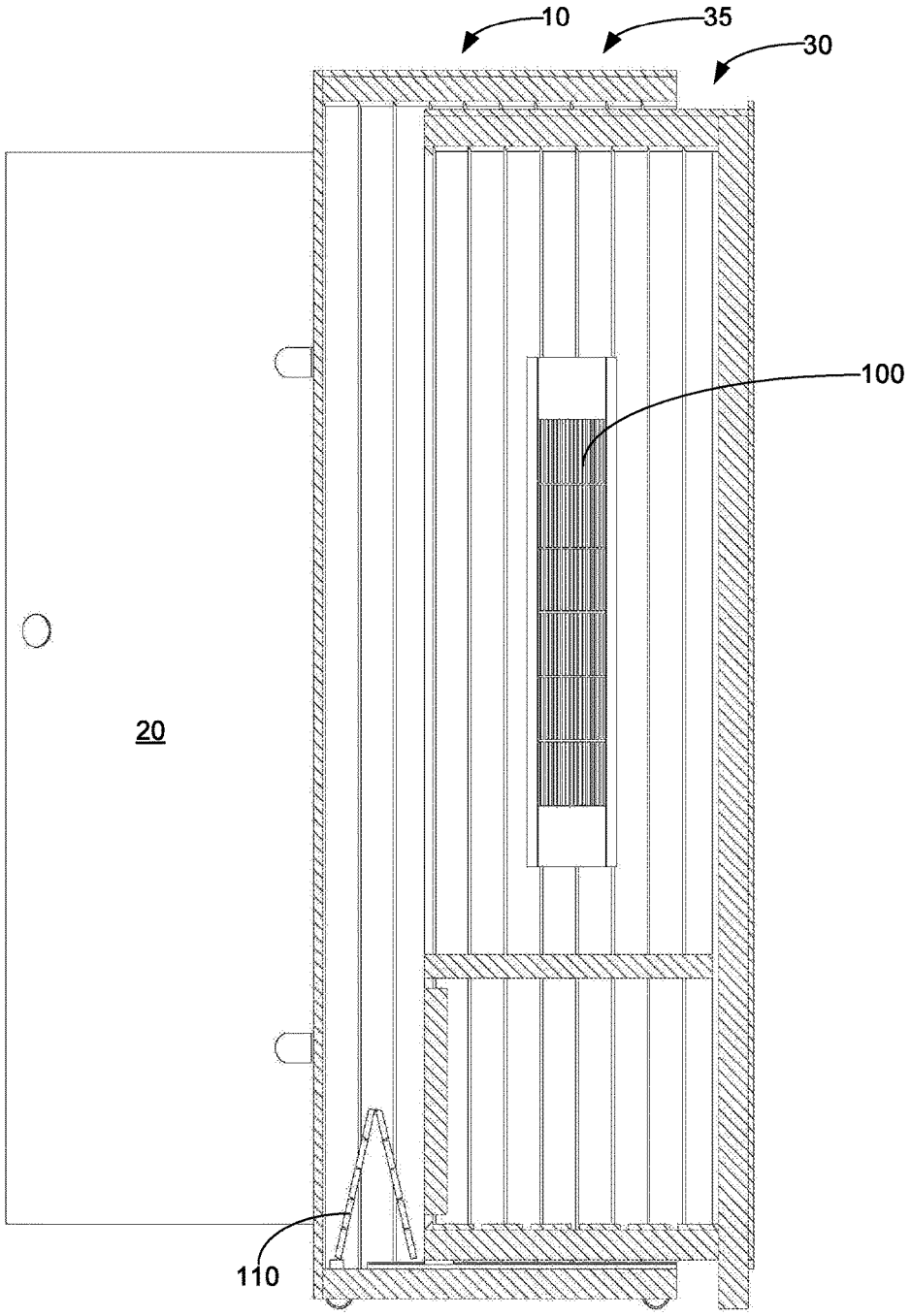
Figure 13C:
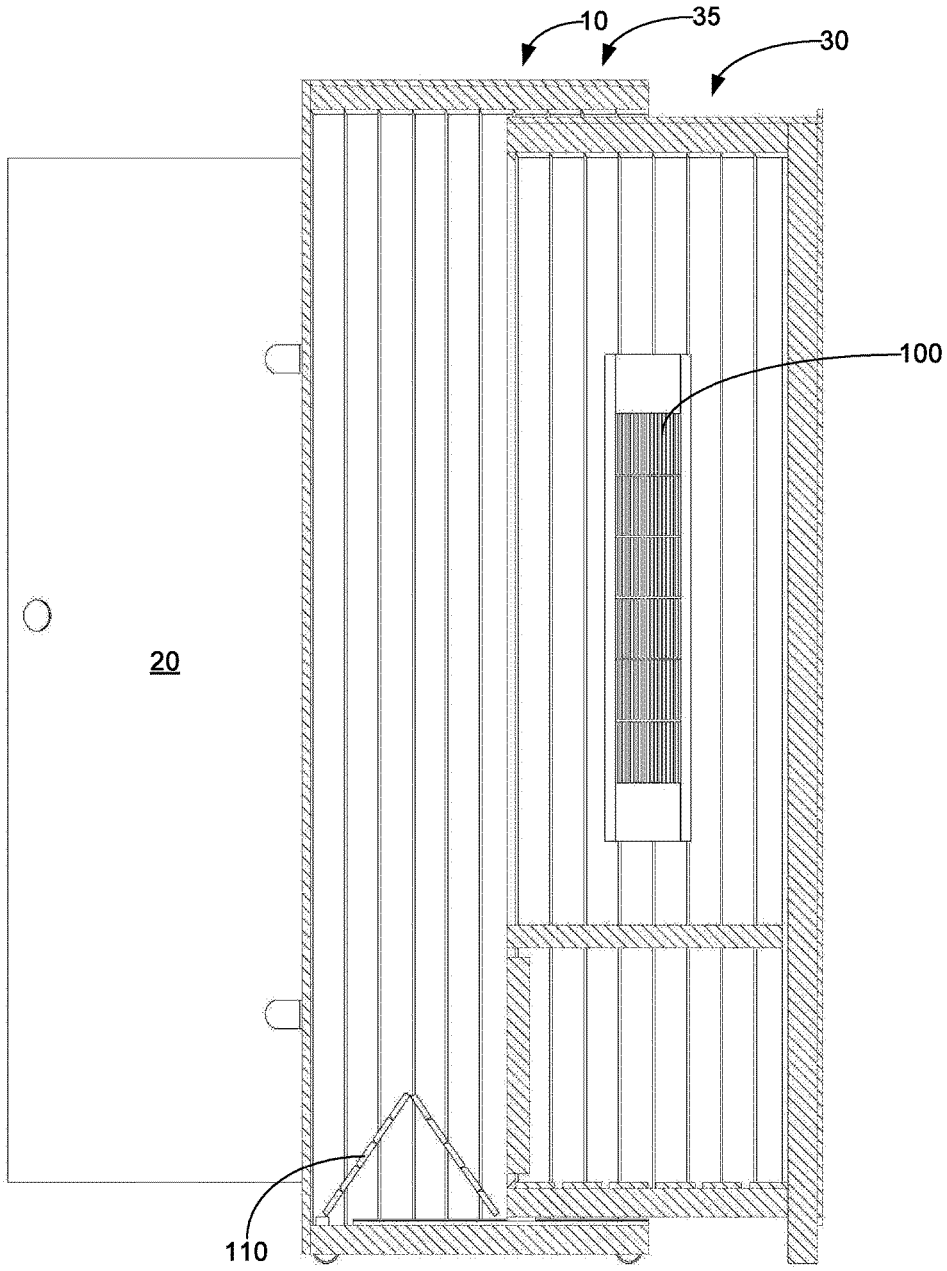
Figure 13D:
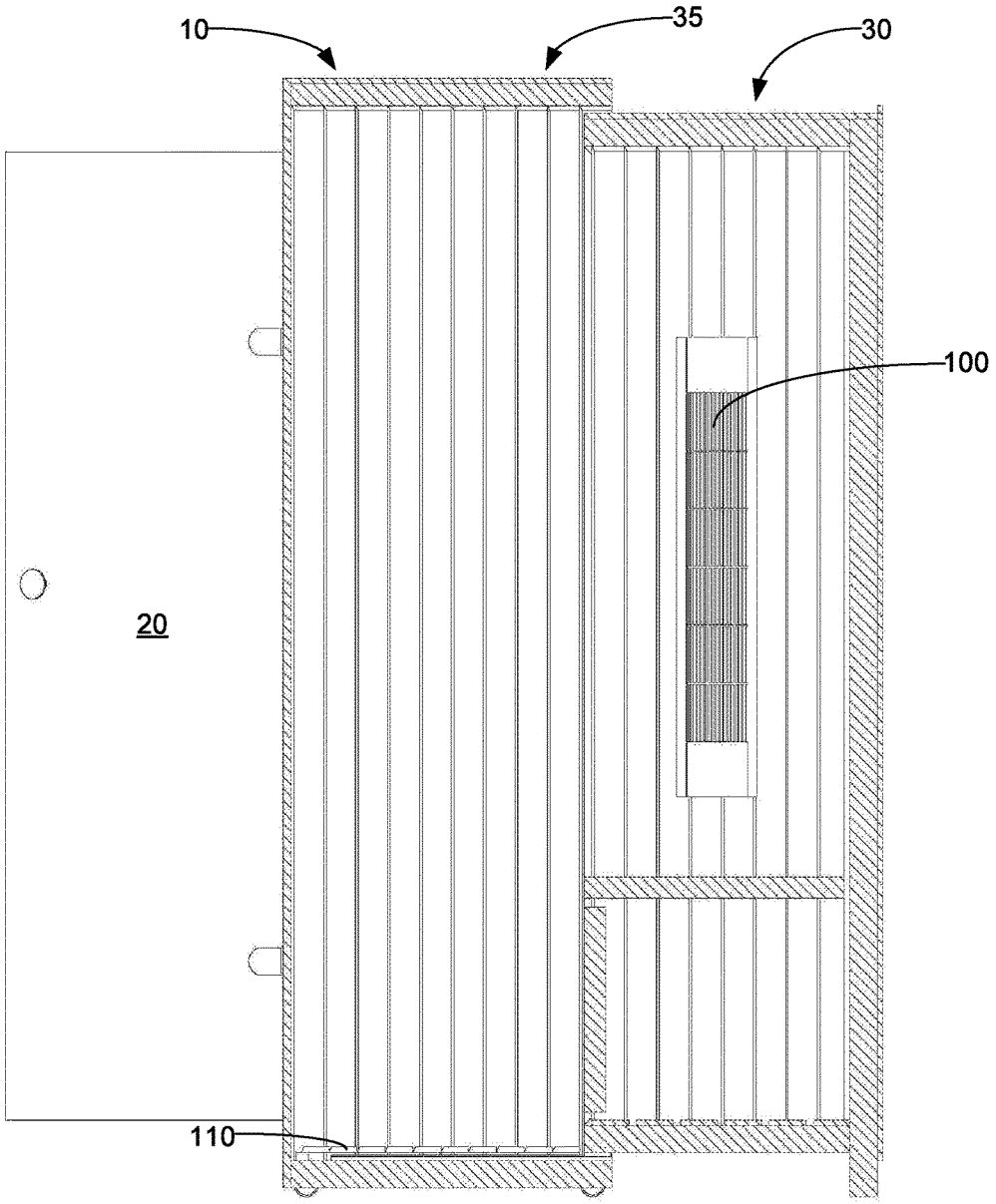

In some embodiments in which the housing 15 comprises one or more additional extension members 105, the extension member 35 is configured to, at least partially, extend from and be retracted into (and/or over) a first side of the base member while at least one additional extension member is configured to, at least partially, extend from and be retracted into (and/or over a second side of) the base member. By way of non-limiting illustration, FIGS. 9A-9B depict an embodiment in which the extension member 35 is configured to extend from and be retracted into the base member and in which an additional extension member 105 is configured to, at least partially, extend from and be retracted into the base member 30 as well as the extension member 35. Similarly, FIGS. 10A-10B depict an embodiment in which the extension member 35 is configured to, at least partially, extend from and be retracted into a first side of the base member 30, while an additional extension member 105 is configured to, at least partially, extend from and be retracted into a second side of the base member 30.

Where the sauna 10 comprises one or more additional extension members 105, the additional extension members can have any suitable component or characteristics that allow the sauna to function as intended. Some non-limiting examples of such components and characteristics include one or more wheels, seals, doors, drive mechanisms, guides, heaters, heater vents, and/or other suitable components. Indeed, in some embodiments in which the sauna is configured to be resized manually and in which the sauna comprises 1 or more additional extension members 105 that are configured to extend from the base member 30 when the sauna is in an extended configuration, the guide for each tier (e.g., the base member, the additional extensions 105, and the extension member 35) are configured such that friction losses of the guide of the last tier are lower than those of the proceeding tier, and so on, all the way to the first extension. Thus, in some such embodiments, when a user pulls on the extension member, it fully extends and when it reaches a catch, it pulls the next additional extension member along with it, and so on, until the last additional extension is extended.

In another example of a manner in which the described sauna 10 can be modified, in some embodiments, instead of having the extension member 35 (and any additional extension members 105) be configured to telescopically extend from and be retracted to the base member 30 (e.g., as shown in FIGS. 1A-1B and 8A-8B), the extension member 35 (and one or more additional extension members 105) are configured to pivotally extend from and be retracted to the base member 30. While such pivotally movable components of the sauna housing 15 can attach to the base member in any suitable manner (e.g., via pivot joint), FIGS. 10A-11B illustrate some non-limiting embodiments of such saunas 10.

In yet another example of a suitable modification to the sauna 10, while the FIGS. to this point illustrate embodiments in which a portion of the extension member 35 (and/or one or more additional extension members 105) are configured to slidably and/or pivotally fit within the base member 30 (e.g., when the sauna is collapsed), FIGS. 12A-12D show that, in some other embodiments, at least a portion of the extension member 35 is configured to slidingly and/or pivotally extend over a portion of the base member 30 when the sauna 10 is in the collapsed position.

As still another example of non-limiting example of a suitable modification to the described sauna 10, the housing 15 comprises one or more accordion style walls, folding walls, walls comprising a flexible material, and/or any other suitable type of wall material.

The described sauna 10 can comprise any suitable materials that allow it to function as intended. Indeed, in some embodiments, the sauna comprises one or more woods (e.g., cedar, aspen, hemlock, poplar, Douglas fir, balsam fir, white fir, eastern white pine, bald cypress, sassafras, and/or any other suitable wood), wood fibers, types of fiberglass, plastics, polymers, types of glass, ceramics, clays, stones, metals, synthetic materials, natural materials, and/or other suitable materials.

The described sauna 10 can also be made in any suitable manner. In this regard, some non-limiting examples of methods for making the described sauna include, cutting; sanding; plaining; shaping; molding; extruding; bending; connecting various pieces with one or more adhesives, mechanical fasteners (e.g., nails, staples, pegs, clips, clamps, rivets, crimps, pins, brads, etc.), and/or by melting pieces together; and/or any other suitable method that allows the described sauna to perform its intended functions.

In addition to the aforementioned features, the described sauna 10 can comprise any other suitable feature. Indeed, some embodiments of the described sauna comprise one or more lights, vents, fans, computers, televisions, speakers, thermostats, thermometers, timers, hygrometers, windows, backrests, headrests, stones, towel racks, racks, buckets, dippers, mirrors, shock absorbers, dampers, and/or other suitable features and/or accessories that allow the sauna to function as intended. Indeed, in one example, the base member 30 comprises one or more feet that are optionally adjustable in height to accommodate the sauna to different support structures.

In another non-limiting example of an additional feature of the sauna 10, in some embodiments, the sauna comprises one or more additional components that bend, flex, collapse, and/or otherwise move as the sauna moves between the collapsed and extended configurations, and vice versa. By way of non-limiting illustration, FIGS. 13A-13D illustrate an embodiment in which the sauna 10 comprises a piece of folding flooring 110.

In addition to the aforementioned features, the described sauna 10 can have several additional features. In one example, when some embodiments of the sauna are in the collapsed configuration, the sauna has a footprint that is less than about 70% (or any subrange thereof, such as less than about 60% or about 55%) of the sauna when it is in the fully extended position. Accordingly, some such embodiments can allow the sauna to occupy relatively small amounts of floor space when the sauna is being stored.

In another example, in some embodiments, the drive mechanism and/or guides are disposed in a location (e.g., between an edge of the base member 30 and the extension member 35 or otherwise) that allows the drive mechanism and/or guides to be accessed relatively easily for repair.

In still another example, in some embodiments, the sauna 10 comprises one or more additional features that add to the sauna's aesthetic appeal. Indeed, in some embodiments, an exterior face of the extension member 35 is sized and shaped to substantially eclipse the base member 30 when the sauna is viewed along a retraction/extension axis of the sauna 10.

Thus, as discussed herein, embodiments of the present invention embrace saunas. More particularly, the some embodiments of the described invention relate to systems and methods for providing and using a collapsible sauna 10. While the sauna can have any suitable characteristics, in some cases, it includes a housing that has at least two pieces, namely a base member and an extension member, which together form an interior sauna chamber. In some cases, the extension member is configured to be extended from the base member to increase an internal volume of the sauna. Additionally, in some cases, the extension member is configured to slide from an extended configuration into the base member, or into a collapsed configuration, to reduce the size of the sauna's footprint.

The present invention may be embodied in other specific forms without departing from its spirit or essential characteristics. The described embodiments, examples, and illustrations are to be considered in all respects only as illustrative and not restrictive. The scope of the invention is, therefore, indicated by the appended claims rather than by the foregoing description. All changes that come within the meaning and range of equivalency of the claims are to be embraced within their scope. In addition, as the terms on, disposed on, attached to, connected to, coupled to, etc. are used herein, one object (e.g., a material, element, structure, member, etc.) can be on, disposed on, attached to, connected to, or coupled to another object—regardless of whether the one object is directly on, attached, connected, or coupled to the other object, or whether there are one or more intervening objects between the one object and the other object. Also, directions (e.g., front back, on top of, below, above, top, bottom, side, up, down, under, over, upper, lower, lateral, etc.), if provided, are relative and provided solely by way of example and for ease of illustration and discussion and not by way of limitation. Where reference is made to a list of elements (e.g., elements a, b, c), such reference is intended to include any one of the listed elements by itself, any combination of less than all of the listed elements, and/or a combination of all of the listed elements. Furthermore, as used herein, the terms a, an, and one may each be interchangeable with the terms at least one and one or more.

What is claimed is:

1. A collapsible sauna, comprising:

a first piece of sauna housing;

a second piece of sauna housing;

a third piece of sauna housing;

a sauna heater;

a first sitting surface; and a second sitting surface, wherein the second piece of sauna housing slidingly couples with the first piece of sauna housing to define an interior sauna chamber, wherein a first portion of the second piece of sauna housing is configured to slidably and telescopically fit within the first piece of sauna housing such that a volume of the sauna chamber is configured to change when at least one of the first piece of sauna housing and the second piece of sauna housing is moved telescopically with respect to the other, wherein the first piece of sauna housing and the second piece of sauna housing each comprise a ceiling that is configured to extend over a user when the user is within the sauna chamber, wherein a portion of the first sitting surface is configured to be forced to pivot towards a storage orientation when the first portion of the second piece of sauna housing is forced telescopically into the first piece of sauna housing, wherein the first portion of the second piece of sauna housing is configured to slidably and telescopically mate with the third piece of sauna housing, wherein a first portion of the third piece of sauna housing is configured to slidably and telescopically mate with the first piece of sauna housing such that the sauna is configured to be telescopically extended and collapsed, and wherein a portion of the second sitting surface is configured to be forced to rotate towards the storage orientation when the third piece of sauna housing and the second piece of sauna housing are forced together towards a collapsed position.

* * * * *